US008196674B2

(12) United States Patent
Ikuta et al.

(10) Patent No.: US 8,196,674 B2
(45) Date of Patent: Jun. 12, 2012

(54) IMPACT TOOL

(75) Inventors: Hiroki Ikuta, Anjo (JP); Shin Nakamura, Anjo (JP); Yoshio Sugiyama, Anjo (JP); Masao Miwa, Anjo (JP); Takuya Sumi, Anjo (JP); Takuo Arakawa, Anjo (JP)

(73) Assignee: Makita Corporation, Anjo-shi (JP)

( * ) Notice: Subject to any disclaimer, the term of this patent is extended or adjusted under 35 U.S.C. 154(b) by 399 days.

(21) Appl. No.: 12/379,528

(22) Filed: Feb. 24, 2009

(65) Prior Publication Data

US 2009/0223691 A1 Sep. 10, 2009

(30) Foreign Application Priority Data

Mar. 5, 2008 (JP) ..... 2008-55214
Mar. 13, 2008 (JP) ..... 2008-64977
Mar. 21, 2008 (JP) ..... 2008-74649

(51) Int. Cl.
*B25D 11/10* (2006.01)

(52) U.S. Cl. ..... 173/162.1; 173/48; 173/162.2; 173/176; 173/217; 173/197; 173/DIG. 3; 310/50; 310/71

(58) Field of Classification Search ..... 173/48, 173/162.1, 162.2, 176, 217, 197, DIG. 3; 310/50, 71
See application file for complete search history.

(56) References Cited

U.S. PATENT DOCUMENTS 3,162,268 A * 12/1964 Short ..... 184/5
3,456,740 A * 7/1969 Bronnert et al. ..... 173/109
4,558,763 A * 12/1985 Montabert ..... 181/230
5,052,497 A * 10/1991 Houben et al. ..... 173/109
5,073,736 A * 12/1991 Gschwender et al. ..... 310/88
6,543,549 B1 * 4/2003 Riedl et al. ..... 173/216
6,763,897 B2 7/2004 Hanke et al.
6,906,438 B2 * 6/2005 Ursel et al. ..... 310/89
6,948,570 B2 9/2005 Kristen et al.
7,308,950 B2 * 12/2007 Faatz et al. ..... 173/217
7,589,448 B2 * 9/2009 Nakano et al. ..... 310/90
2004/0108124 A1 6/2004 Kristen et al.

(Continued)

FOREIGN PATENT DOCUMENTS

EP 1 252 976 A1 10/2002

(Continued)

OTHER PUBLICATIONS

Nov. 17, 2009 Search Report issued in European Patent Application No. 09002870.5.

*Primary Examiner* — Brian D Nash
*Assistant Examiner* — Michelle Lopez
(74) *Attorney, Agent, or Firm* — Oliff & Berridge, PLC

(57) ABSTRACT

It is an object of the invention to provide a technique that contributes to further improvement of an impact tool. A representative impact tool includes a motor, a tool body that houses the motor, a dynamic vibration reducer and a driving mechanism part that is driven by the motor and forcibly drives the dynamic vibration reducer by applying an external force other than vibration of the tool body to the dynamic vibration reducer, during hammering operation. At least one of the dynamic vibration reducer and the driving mechanism part is mounted to the tool body in a form of an assembly into which at least one of a plurality of component parts forming the dynamic vibration reducer and a plurality of component parts forming the driving mechanism part are assembled in advance.

8 Claims, 13 Drawing Sheets

U.S. PATENT DOCUMENTS

| | | | | |
|---|---|---|---|---|
| 2004/0263008 | A1 * | 12/2004 | Voigt et al. | 310/58 |
| 2005/0168085 | A1 * | 8/2005 | Ihata et al. | 310/90 |
| 2007/0044984 | A1 | 3/2007 | Fischer et al. | |
| 2007/0103019 | A1 * | 5/2007 | Nakano et al. | 310/90 |
| 2009/0121570 | A1 * | 5/2009 | Nishikawa et al. | 310/90 |
| 2009/0127972 | A1 * | 5/2009 | Ishida et al. | 310/218 |

FOREIGN PATENT DOCUMENTS

| | | | |
|---|---|---|---|
| EP | 1 437 200 | A1 | 7/2004 |
| EP | 1 439 038 | A1 | 7/2004 |
| GB | 2 399 615 | A | 9/2004 |
| JP | A-2003-11073 | | 1/2003 |
| JP | A-2004-174710 | | 6/2004 |
| JP | A-2006-62039 | | 3/2006 |
| JP | A-2007-44869 | | 2/2007 |
| WO | WO 2004082897 | A1 * | 9/2004 |
| WO | WO 2007/077946 | A2 | 7/2007 |

* cited by examiner

IMPACT TOOL

BACKGROUND OF THE INVENTION

1. Field of the Invention

The present invention relates to a vibration reducing technique of an impact tool such as a hammer and a hammer drill.

2. Description of the Related Art (1st Known Art)

Japanese non-examined laid-open Patent Publication No. 2003-11073 discloses an electric hammer having a vibration reducing mechanism. This known electric hammer has a dynamic vibration reducer to reduce vibration caused in the axial direction of the hammer bit during hammering operation. The dynamic vibration reducer has a weight that can linearly move under a biasing force of a coil spring, and the dynamic vibration reducer reduces vibration of the hammer during hammering operation by the movement of the weight in the axial direction of the tool bit.

In the known electric hammer, the weight and the coil spring are disposed within a space having an annular section between a cylinder and a barrel part that houses the cylinder.

In the above-described arrangement and construction, component parts of the dynamic vibration reducer such as the weight and the coil spring need to be individually mounted to the cylinder or the barrel part. Thus, in the known electric hammer, further improvement is required in ease of assembly of the vibration reducing mechanism.

(2nd Known Art)

As another known art, a conventional electric hammer has a motor which linearly drives a hammer bit in the axial direction of the hammer bit. In a motor having a brush holder which is arranged on one end side of the motor along its axis of rotation and holds carbon brushes for supplying electric current, a motor cover is removably mounted for replacement of the carbon brushes which are consumables. A construction in which a motor housing for housing a motor is covered with a motor cover on the side of one axial end of the motor is disclosed, for example, in Japanese non-examined laid-open Patent Publication No. 2007-44869.

The known motor cover is designed and provided to cover the motor, particularly the brush holder and its surrounding region, and serves only as a cover.

(3rd Known Art)

As further another known art, Japanese non-examined laid-open Patent Publication No. 2004-174710 discloses a motor-driven power tool. In this known power tool, a controller is electrically connected to a driving motor by a plurality of lead wires, and power is supplied from a power source to the controller and then to a driving motor via the lead wires. In design of a power tool of this type, however, a further technique for improving ease of mounting electrical components such as a controller is required.

SUMMARY OF THE INVENTION

Accordingly, it is an object of the invention to provide a technique that contributes to further improvement of an impact tool.

Particularly, the object of the invention specifically reflects the following aspects:

(1) To provide a technique that contributes to further improvement in ease of assembly of the vibration reducing mechanism in an impact tool.

(2) To provide a technique of providing an additional function for a covering member for covering internal mechanisms housed within a tool body in an impact tool.

(3) To provide a technique that contributes to improvement in ease of mounting electrical components relating to power supply to a driving motor for driving a tool bit, in an impact tool.

Above-described object (1) can be solved by an invention as claimed. A representative impact tool according to the present invention performs a predetermined hammering operation on a workpiece by a striking movement of a tool bit in an axial direction of the tool bit. The impact tool includes a motor, a tool body, a dynamic vibration reducer and a driving mechanism part. The motor drives the tool bit. The tool body houses the motor. The dynamic vibration reducer reduces vibration of the tool body during hammering operation. The driving mechanism part is driven by the motor and forcibly drives the dynamic vibration reducer by applying an external force other than vibration of the tool body to the dynamic vibration reducer, during hammering operation. The "predetermined hammering operation" in this invention suitably includes not only a hammering operation in which the tool bit performs only a linear striking movement, but an electrical hammering operation in which the tool bit performs a linear striking movement and a circumferential rotation.

In this invention, when using a hand-held impact tool, in relation to the technique of forcibly driving the dynamic vibration reducer by applying an external force other than vibration of the tool body to the dynamic vibration reducer, a design vibration value of the impact tool, or a theoretically estimated value of vibration which may be caused in the impact tool during operation, may be actually outputted as a lower value than the estimate due to the user's pressing operation by hand. Therefore, the dynamic vibration reducer is forcibly and steadily driven by application of a predetermined external force other than vibration of the tool body to the dynamic vibration reducer. In a state in which the apparent vibration value of the tool body is lower or in which the user's hand receives a substantial amount of vibration caused in the tool body, the dynamic vibration reducer is provided with a vibration reducing function which is adaptable to vibrations of higher values substantially corresponding to design vibration value, so that the user's hand is prevented from unnecessarily receiving vibration of the tool body.

According to the preferred embodiment of this invention, at least one of the dynamic vibration reducer and the driving mechanism part is mounted to the tool body in a form of an assembly into which at least one of a plurality of component parts forming the dynamic vibration reducer and a plurality of component parts forming the driving mechanism part are assembled in advance.

Therefore, according to this invention, at least one of the dynamic vibration reducer forming a vibration reducing mechanism and the driving mechanism part is provided in the form of an assembly so that it can be handled as one part. Therefore, mounting operation to the tool body can be facilitated and ease of assembly is increased. Further, the assembly can be removed as one part so that ease of repair is increased.

According to a further embodiment of the present invention, the impact tool further includes a barrel part connected to the tool body, and a cylinder disposed within the barrel part. The dynamic vibration reducer includes a weight that can linearly move in the axial direction of the tool bit and an elastic element that applies a biasing force to the weight in the axial direction of the tool bit. Further, the weight and the elastic element are mounted to either one of the cylinder and the barrel part in order to form an assembly.

According to this invention, the dynamic vibration reducer is mounted to either the cylinder or the barrel part so that it can be handled as one part integrated with the cylinder or the barrel part. Therefore, the dynamic vibration reducer can be mounted to the tool body simply by mounting the cylinder or the barrel part to the tool body.

According to a further embodiment of the present invention, the driving mechanism part includes a cam shaft that is rotationally driven by the motor, an eccentric cam that is integrally formed or fixedly connected with the cam shaft, a bearing that rotatably supports at least one axial end of the cam shaft, and a bearing housing that houses the bearing, all of which are assembled into the driving mechanism part. The driving mechanism part further includes two pins disposed in series in the axial direction of the tool bit. The pins are caused to linearly move in the axial direction of the hammer bit by rotation of the eccentric cam in order to forcibly drive the dynamic vibration reducer. One of the pins which is adjacent to the eccentric cam is mounted to the bearing housing transversely to the axis of the cam shaft. As a result, the driving mechanism part forms an assembly.

Thus, according to this invention, the cam shaft with which the eccentric cam is integrally formed or fixedly connected is mounted to the bearing housing via the bearing, and the pin adjacent to the eccentric cam is further mounted to the bearing housing, so that an assembly is formed. Therefore, the assembly can be easily mounted to the tool body by inserting the bearing housing into the tool body in the axial direction of the cam shaft, for example, through an opening formed in the tool body for mounting the driving mechanism and then fixing it to the tool body.

Two pins disposed in series in the axial direction of the tool bit are provided which convert rotation of the eccentric cam into linear motion and transmit it to the weight, as a driving force acting in the axial direction of the tool bit, via the elastic element of the dynamic vibration reducer. The pin adjacent to the eccentric cam is required to have some large diameter in order to ensure stability of movement.

The barrel part is fitted onto a cylindrical portion formed in the tool body. In a construction in which the pin remote from the eccentric cam is mounted, for example, to the cylindrical portion, if the pin has a large diameter, the cylindrical portion is required to have a greater thickness. Accordingly, the diameter of the cylindrical portion is increased. In this invention, the power transmitting pin consists of two pins, and the pin adjacent to the eccentric cam is incorporated into the assembly. Therefore, the pin remote from the eccentric cam can be designed to have the smallest possible diameter to the extent that adequate strength is ensured. As a result, the diameter of the cylindrical portion for mounting the barrel part and thus the diameter of the barrel part can be reduced.

According to a further embodiment of the present invention, the impact tool further includes a driving mechanism that converts a rotating output of the motor into linear motion and drives the tool bit, and an enclosed housing space that houses the driving mechanism. The air bleeding mechanism and the filler port cap are mounted to the bearing housing after the bearing housing is mounted to the tool body, so that an assembly of the driving mechanism part is formed. The air bleeding mechanism provides communication between the inside and the outside of the housing space and regulates pressure of the housing space and the filler port cap closes an oil filler port from which lubricating oil is supplied into the housing space. Typically, the "air bleeding mechanism" in this invention mainly includes a cylindrical member that has an air passage for communicating the inside and the outside of the housing space of the driving mechanism and houses a filter for absorbing lubricating oil in the air passage. The air bleeding mechanism is mounted to the bearing housing, for example, by fitting into an opening formed in a bearing housing part of the bearing housing in the axial direction of the cam shaft Thus, according to this invention, an assembly is formed by mounting the air bleeding mechanism and the filler port cap to the bearing housing, so that ease of assembly can be further improved.

Particularly, above-described object (2) can be solved by the other representative impact tool according to the invention which includes a tool body, a plurality of internal mechanisms housed within the tool body, a motor as one of the internal mechanisms, and a motor shaft as one of the internal mechanisms. The motor shaft is rotationally driven when the motor is driven, and the motor shaft is arranged to cross an axis of the tool bit. The impact tool further includes a covering member which is mounted to the tool body on the side of one axial end of the motor shaft and covers the end of the motor shaft, and the covering member retains at least part of the internal mechanisms. According to the invention, the covering member has not only a function of covering internal mechanisms, but a function of retaining internal mechanisms, so that it is not necessary to provide an additional mechanism for retaining the internal mechanisms which are retained by the covering member.

Further, the motor may include a rotor that rotates together with the motor shaft, a bearing that supports an axial end of the motor shaft, and a brush holder unit that is disposed between the rotor and the bearing and holds carbon brushes for supplying electric current to the rotor. The internal mechanism to be retained by the covering member may be a bearing housing part that houses the bearing, and the covering member retains the bearing housing part by pressing in a radial direction of the motor shaft while pressing from the side of the axial end of the motor shaft. The "bearing housing part" in this invention is typically provided integrally as a part of the motor housing on the one end side of the motor housing in the direction of the axis of the motor. Therefore, in the construction in which the brush holder unit is disposed between the rotor and the bearing, the brush holder unit is arranged in a connecting region between a body region for housing the rotor and the bearing housing part for housing the bearing. Therefore, no reinforcing rib can be provided in the connecting region between the body region and the bearing housing part located on the end in the direction of the axis of the motor, and an opening is formed in the connecting region in order to allow the brush holder for holding at least the carbon brushes to protrude to the motor shaft (commutator) side through the opening. For such reasons, the connecting region may be reduced in strength and cause runout during driving of the motor.

However, according to the invention, the construction in which the covering member presses the bearing housing part in the radial direction of the motor shaft while pressing it from the side of the axial end of the motor shaft, can compensate for strength reduction of the connecting region between the body region and the bearing housing part which is caused by providing the brush holder unit.

Further, the impact tool may further include a driving shaft as one of the internal mechanisms which is rotationally driven by the motor shaft, and a driving mechanism as one of the internal mechanisms which converts a rotating output of the driving shaft into linear motion and linearly drives the tool bit. The tool body may have an enclosed housing space that houses the driving shaft and the driving mechanism. The internal mechanism to be retained by the covering member is an air bleeding mechanism that provides communication between the inside and the outside of the housing space and regulates pressure of the housing space. Further, the covering member retains the air bleeding mechanism by pressing from the side of the axial end of the motor shaft. Typically, the "air bleeding mechanism" mainly includes a cylindrical member that has an air passage for communicating the inside and the outside of the housing space and houses a filter for absorbing lubricating oil in the air passage. The air bleeding mechanism may be mounted, for example, by fitting into an opening formed in the tool body that houses the driving mechanism, along the direction of the axis of the motor shaft. Further, as the filter, felt, sponge, cloth, etc. can be suitably used, but materials which can absorb and catch lubricant can also be appropriately used.

With the construction in which the covering member retains the air bleeding mechanism by pressing from the side of the axial end of the motor shaft, the air bleeding mechanism can be reliably prevented from falling out due to the internal pressure of the housing space.

Further, the impact tool may further include a driving shaft as one of the internal mechanisms which is rotationally driven by the motor shaft, and a driving mechanism as one of the internal mechanisms which converts a rotating output of the driving shaft into linear motion and linearly drives the tool bit. The tool body includes an enclosed housing space that houses the driving shaft and the driving mechanism. The internal mechanism to be retained by the covering member is a filler port cap that closes an oil filler port from which lubricating oil is supplied into the housing space, and the covering member retains the filler port cap by pressing from the side of the axial end of the motor shaft. As a result, the filler port cap can be reliably prevented from falling out due to the internal pressure of the housing space.

According to the invention, a technique of providing an additional function is provided for a covering member for covering internal mechanisms housed within a tool body in an impact tool.

Particularly, above-described object (3) can be solved by the other representative impact tool according to the invention which includes at least a driving motor, a tool body, a brush holder unit, a connecting terminal, a power terminal, a power switch and a control unit. The driving motor is designed to drive the tool bit. In this case, a motor shaft that is caused to rotate by driving of the driving motor may be arranged to cross an axis of the tool bit, or it may be arranged such that its extension crosses the axis of the tool bit, but the motor shaft itself does not cross the axis of the tool bit. Further, the tool bit which is driven by the driving motor may be a component part of the impact tool according to this invention, or it may be a separate part from the impact tool. The tool body is designed as a housing part that houses the driving motor. The brush holder unit is designed as a holding part that holds a plurality of motor brushes for supplying electric power to the driving motor. The connecting terminal can be connected to a connected terminal of the brush holder unit by plugging in. The manner of "plugging in" may typically represent a manner of plugging a male terminal in a female terminal for terminal connection and include the manner in which a connecting terminal in the form of a male terminal is plugged in a connected terminal in the form of a female terminal. The power terminal is designed as a terminal to which a power cord is connected. The power switch can switch between a state in which the driving motor is energized and a state in which the driving motor is de-energized. The control unit has a function of performing controls relating to power supply to the driving motor.

Particularly, electrical components including the connecting terminal, the power terminal, the power switch and the control unit are integrally mounted to a housing and thus form an electrical component assembly. Thus, the electrical component assembly is mounted to the body side by connecting the connecting terminal to the connected terminal by plugging in. Therefore, with such a construction, various electrical components installed in the housing can be handled as one part in the form of the electrical component assembly. Further, the electrical components can be easily mounted to the tool body side in one operation by plug-in terminal connection between the connecting terminal and the connected terminal. Therefore, ease of mounting the electrical components can be improved. Further, the electrical component assembly can be removed as one part so that ease of repair is increased.

Further, in the electrical component assembly, a motor speed sensor for detecting information relating to rotation speed of the driving motor may preferably be integrally mounted to the housing, and the control unit outputs control signals relating to rotation speed control to the driving motor based on the information detected by the motor speed sensor. The "information relating to rotation speed of the driving motor" may typically include rotation speed itself and various information relating to the rotation speed. Further, the "rotation speed control" may typically include the manner of controlling to match actual rotation speed with a rotation speed setting which is freely set by the user. Further, in the control unit, an output part that outputs control signals relating to motor speed control to the driving motor may also have a function as an output part that outputs control signals relating other than motor speed control, or the output parts may be separately independently provided. With such a construction, the electrical component assembly is provided in which, in addition to the electrical components including the connecting terminal, the power terminal, the power switch and the control unit, a mechanism for controlling rotation speed of the driving motor is integrally mounted to the housing.

Preferably, the electrical component assembly may be disposed at the rear of the tool body between the tool body and a handle to be held by a user, and terminal connection between the connected terminal and the connecting terminal is made by inserting the connecting terminal into the connected terminal provided in the rear of the tool body, in a direction transverse to a motor shaft which is caused to rotate by driving of the driving motor. Typically, the connected terminal can be designed as a female terminal and the connecting terminal as a male terminal which can be plugged in the connected terminal. The rear side of the tool body here is the side of the tool body which is remote from the tool bit, provided that the tool bit side of the tool body is taken as the front side. With such a construction, mounting of the electrical component assembly and terminal connection can be achieved by inserting the connecting terminal provided on the electrical component assembly into the connected terminal provided in the rear of the tool body, in a direction transverse to the motor shaft of the driving motor.

Further, the motor shaft caused to rotate by driving of the driving motor may be arranged to cross an axis of the tool bit. With this construction, in the impact tool in which the motor shaft is arranged to cross an axis of the tool bit, ease of mounting electrical components can be improved.

Preferably, the power cord itself connected to the power terminal may be retained on the housing. As for retaining of the power cord itself, the power cord may be directly retained on the housing, or it may be indirectly retained on the housing via an intervening member such as a cord guard disposed between the power cord and the housing. With such a construction, the electrical component assembly is provided in which, in addition to the electrical components including the connecting terminal, the power terminal, the power switch and the control unit, the power cord itself is integrally mounted to the housing.

According to the invention, ease of mounting electrical components relating to power supply to a driving motor for driving the tool bit can be improved.

Other objects, features and advantages of the present invention will be readily understood after reading the following detailed description together with the accompanying drawings and the claims.

DETAILED DESCRIPTION OF THE INVENTION

Each of the additional features and method steps disclosed above and below may be utilized separately or in conjunction with other features and method steps to provide and manufacture improved impact tools and method for using such impact tools and devices utilized therein. Representative examples of the present invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

Figure 1:
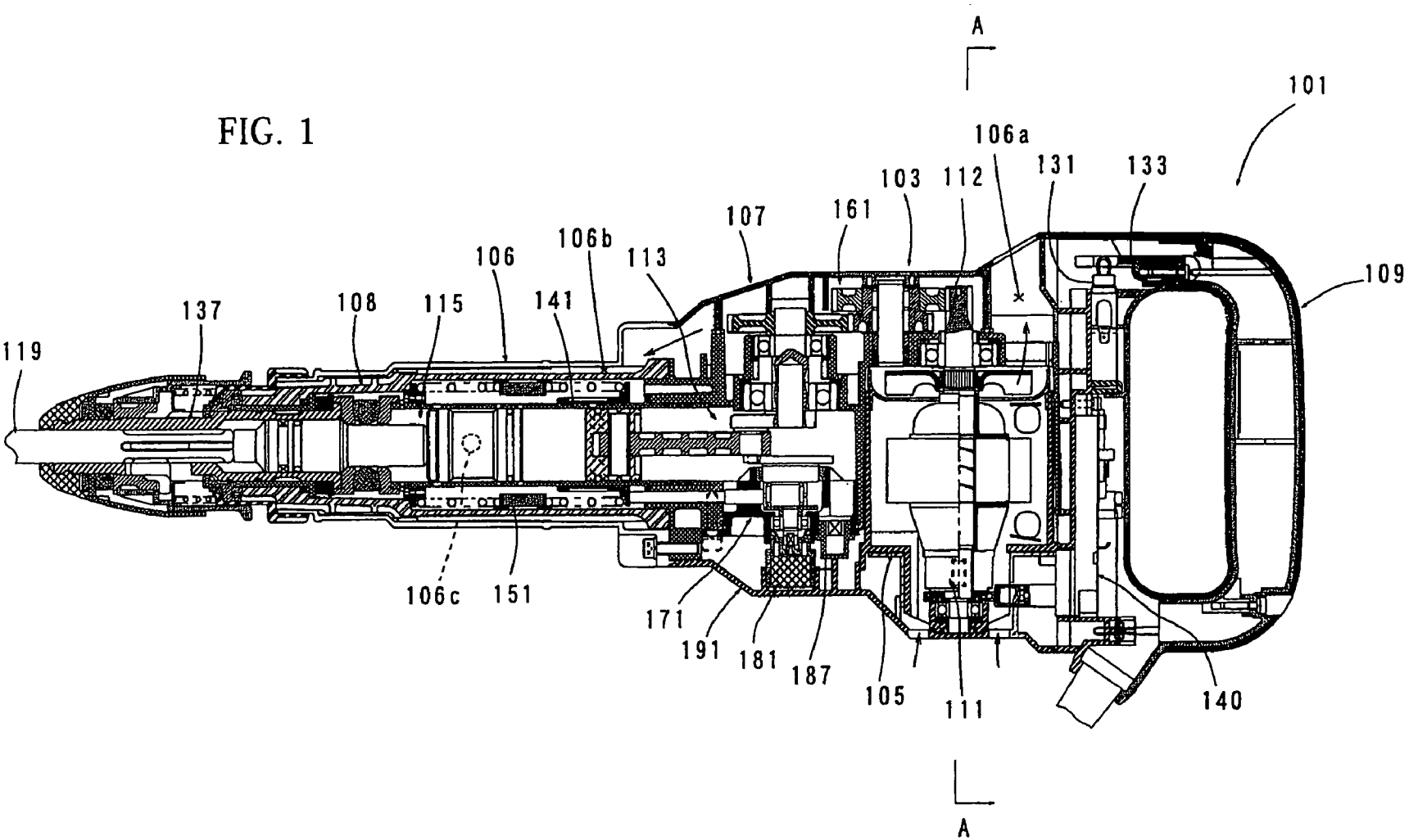
FIG. 1 is a sectional view schematically showing an entire electric hammer according to an embodiment of this invention.

As shown in FIG. 1, a representative electric hammer 101 according to the invention includes a body 103 that forms an outer shell of the hammer 101, a tool holder 137 connected to the tip end region (on the left side as viewed in FIG. 1) of the body 103 in its longitudinal direction, a hammer bit 119 detachably coupled to the tool holder 137, and a handgrip 109 that is connected to the other end (on the right side as viewed in FIG. 1) of the body 103 and designed to be held by a user. The body 103 and the hammer bit 119 are features that correspond to the "tool body" and the "tool bit", respectively, according to the present invention. The hammer bit 119 is held by the tool holder 137 such that it is allowed to reciprocate with respect to the tool holder 137 in its axial direction (in the longitudinal direction of the body 103) and prevented from rotating with respect to the tool holder 137 in its circumferential direction. For the sake of convenience of explanation, the side of the hammer bit 119 is taken as the front side and the side of the handgrip 109 as the rear side.

The body 103 mainly includes a motor housing 105 that houses a driving motor 111, and a gear housing 107 that is connected to the motor housing 105 and houses a motion converting mechanism 113. A barrel part 108 is disposed at the front of the gear housing 107 and houses a striking mechanism 115. The gear housing 107 is disposed in front and upper regions around the motor housing 105. The barrel part 108 is connected to the front end of the gear housing 107 and extends forward along the axis of the hammer bit 119. The handgrip 109 is generally U-shaped having an open front and connected to the rear of the motor housing 105. A power switch 131 for electrically driving the driving motor 111 and an actuating member 133 for actuating the power switch 131 between on and off positions are disposed in the upper region of the handgrip 109. The actuating member 133 is mounted to the handgrip 109 such that it can slide in a horizontal direction (lateral direction) transverse to the axial direction of the hammer bit. When the actuating member 133 is actuated or slid into the on position by the user's finger, the driving motor 111 is electrically driven.

The rotating output of the driving motor 111 is appropriately converted into linear motion via the motion converting mechanism 113 and transmitted to the striking element 115. As a result, an impact force is generated in the axial direction of the hammer bit 119 via the striking element 115. The driving motor 111 is arranged such that the axis of a motor shaft 112 crosses the axis of the hammer bit 119. The motion converting mechanism 113, which serves to convert the rotating output of the driving motor 111 into linear motion and transmit it to the striking element 115, is disposed in the upper region of the internal space of the gear housing 107.

The motion converting mechanism 113 serves to convert rotation of the driving motor 111 into linear motion and transmit it to the striking element 115. The motion converting mechanism 113 forms a crank mechanism which includes a crank shaft 121 rotationally driven by the driving motor 111, a crank plate 124 that rotates together with the crank shaft 121, an eccentric pin 122 that is disposed in a position displaced from the center of rotation of the crank plate 124, a crank arm 123 that is connected to the crank plate via the eccentric pin 122, and a piston 125 that is caused to reciprocate via the crank arm 123. The piston 125 forms a driving element that drives the striking element 115 and can slide within a cylinder 141 in the axial direction of the hammer bit 119.

The crank mechanism is arranged in front of the driving motor 111 and driven by the driving motor 111 at a lower speed via a reduction gear mechanism 161. The reduction gear mechanism 161 mainly includes a small gear 112*a* formed on the motor shaft 112, an intermediate gear 163 that engages with the small gear 112*a*, an intermediate shaft 165 that rotatably supports the intermediate gear 163, and a driven gear 167 that engages with the intermediate gear 163. The driven gear 167 is fixed to the crank shaft 121 such that it rotates together with the crank shaft 121. The crank shaft 121 is arranged such that its axis crosses the axis of the hammer bit and extends parallel to the motor shaft 112 as well as the intermediate shaft 165. The crank mechanism and the reduction gear mechanism 161 form the "driving mechanism" according to this invention. The crank mechanism is housed within a crank chamber 116 which is an enclosed internal space within the gear housing 107. The reduction gear mechanism 161 is housed within a gear chamber 117 which is also an enclosed internal space within the gear housing 107 and located above the crank chamber 116. The crank chamber 116 and the gear chamber 117 are features that correspond to the "housing space" according to this invention.

The striking mechanism 115 includes a striking element in the form of a striker 143 that is slidably disposed within the bore of the cylinder 141, and an intermediate element in the form of an impact bolt 145 that is slidably disposed within the tool holder 137 and transmits the kinetic energy of the striker 143 to the hammer bit 119. An air chamber 141*a* is defined between the piston 125 and the striker 143 within the cylinder 141. The striker 143 is driven via the action of an air spring of the air chamber 141*a* of the cylinder 141 which is caused by sliding movement of the piston 125. The striker 143 then collides with (strikes) the intermediate element in the form of the impact bolt 145 that is slidably disposed within the tool holder 137, and transmits the striking force to the hammer bit 119 via the impact bolt 145.

During operation of the hammer 101 (when the hammer bit 119 is driven), impulsive and cyclic vibration is caused in the body 103 in the axial direction of the hammer bit. Main vibration of the body 103 which is to be reduced is a compressing reaction force which is produced when the piston 125 and the striker 143 compress air within the air chamber 141*a*, and a striking reaction force which is produced with a slight time lag behind the compressing reaction force when the striker 143 strikes the hammer bit 119 via the impact bolt 145.

Figure 2:
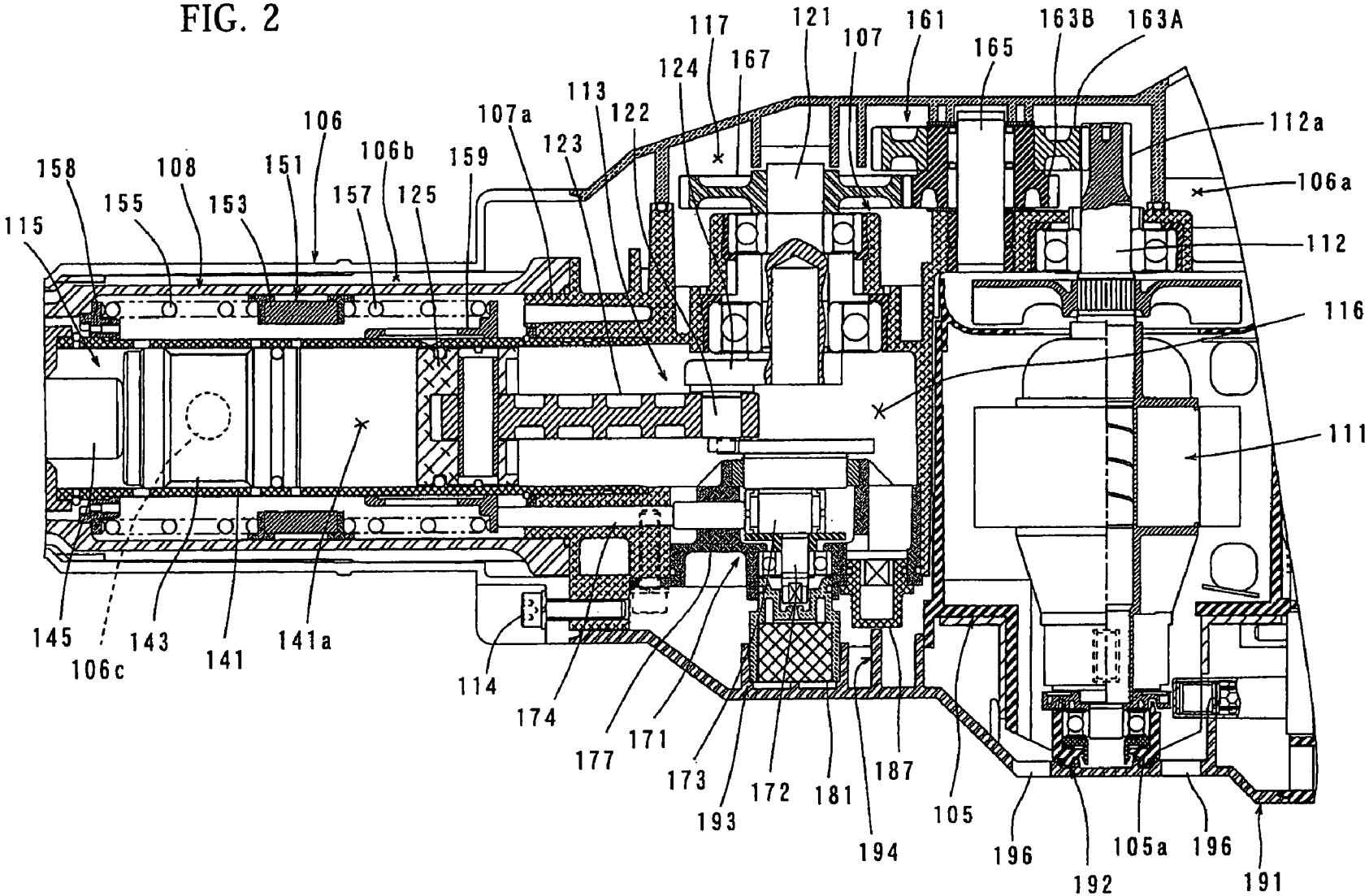
FIG. 2 is a sectional view showing an essential part of the hammer.

As shown in FIG. 2, the hammer drill 101 has a dynamic vibration reducer 151 and a vibration mechanism 171 for forcibly (actively) driving the dynamic vibration reducer 151. The dynamic vibration reducer 151 and the vibration mechanism 171 are features that correspond to the "dynamic vibration reducer" and the "driving mechanism part", respectively, according to this invention.

Figure 3:
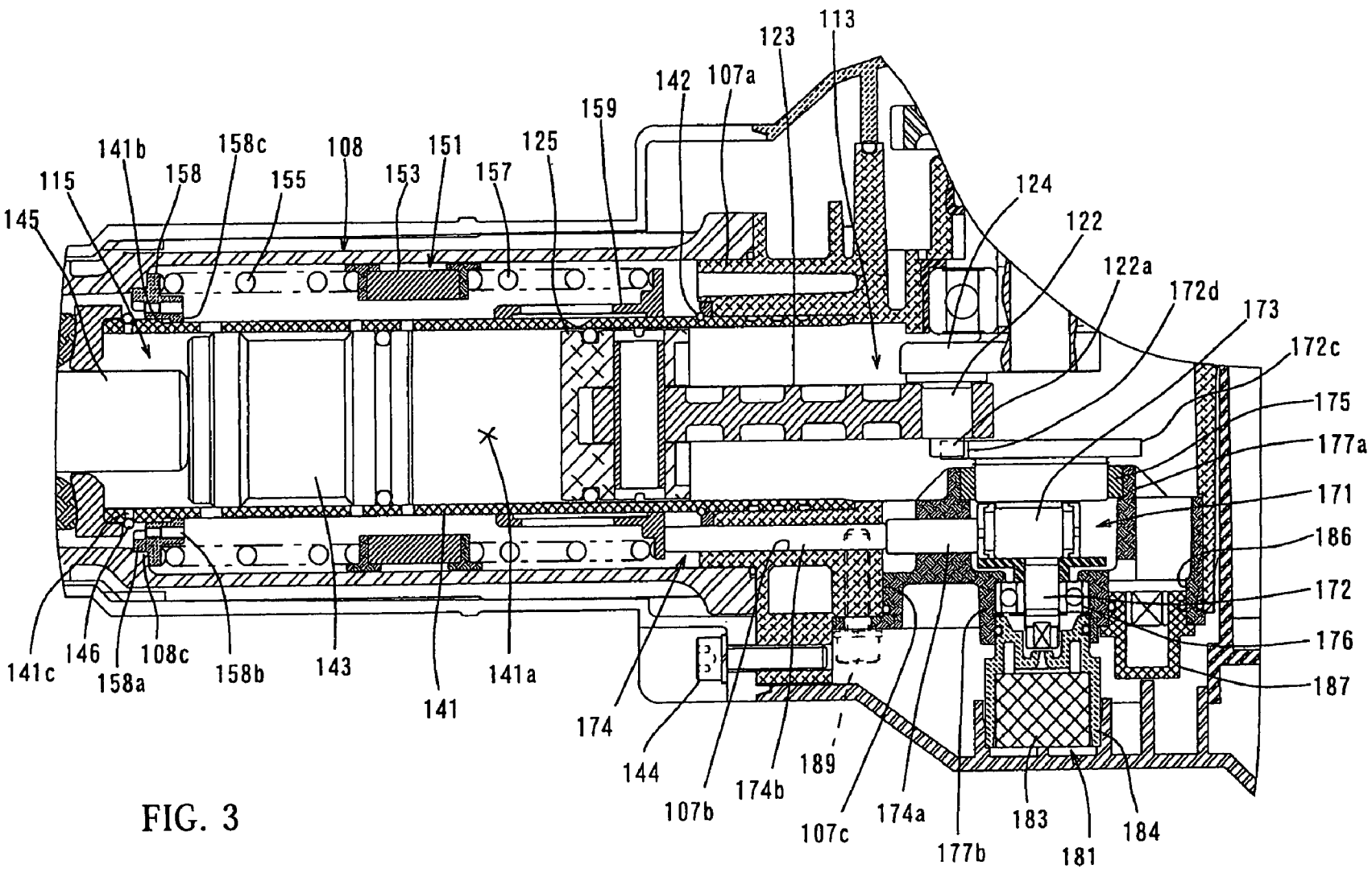
FIG. 3 is a partially enlarged view of FIG. 2.
Figure 4:
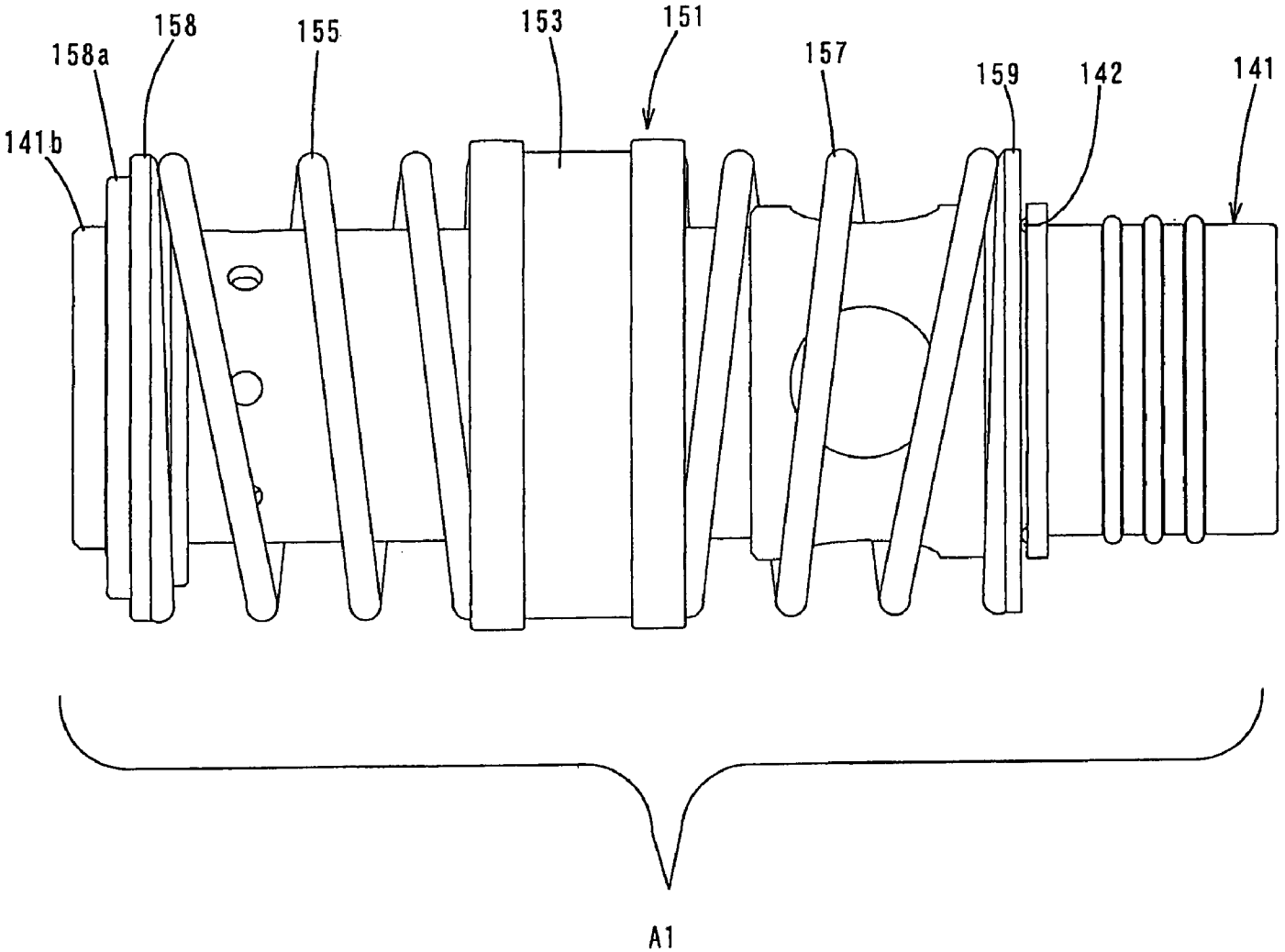
FIG. 4 is an external view of a dynamic vibration reducer assembly.

As shown in FIG. 4, the dynamic vibration reducer 151 is provided in the form of the dynamic vibration reducer assembly A1 or in the assembled form in which a plurality of component parts of the dynamic vibration reducer 151, or a weight 153 and two coil springs 155, 157, are mounted onto the cylinder 141. In the form of this dynamic vibration reducer assembly A1, as shown in FIGS. 2 and 3, the dynamic vibration reducer 151 is mounted to the gear housing 107 and housed within the barrel part 108. The dynamic vibration reducer 151 mainly includes an annular vibration reducing weight 153 and front and rear coil springs 155, 157 disposed on the front and rear sides of the weight 153 in the axial direction of the hammer bit. The coil springs 155, 157 are features that correspond to the "elastic element" according to the present invention.

The weight 153 is disposed outside the cylinder 141. The front coil spring 155 is disposed between a front spring receiving sleeve 158 and a frond end surface of the weight 153. The front spring receiving sleeve 158 is fitted on the front end of the periphery of the cylinder 141 such that it can slide in the axial direction of the hammer bit. The rear coil spring 157 is disposed between a rear spring receiving sleeve 159 and a rear end surface of the weight 153. The rear spring receiving sleeve 159 is fitted on the rear end of the periphery of the cylinder 141 such that it can slide in the axial direction of the hammer bit. The front and rear coil springs 155, 157 exert respective biasing forces on the weight 153 toward each other in the axial direction of the hammer bit. In other words, the weight 153 can move in the axial direction of the hammer bit under the biasing forces of the front and rear coil springs 155, 157 which act upon it toward each other. As shown in FIG. 3, a front end surface of a small-diameter portion 158*c* of the front spring receiving sleeve 158 can come into contact with a rear end surface of a front end large-diameter portion 141*b* of the cylinder 141 in the axial direction, so that the front spring receiving sleeve 158 is prevented from becoming dislodged forward. Further, by contact of a rear end surface of the rear spring receiving sleeve 159 with a stopper ring 142 fitted on the rear periphery of the cylinder 141, the rear spring receiving sleeve 159 is prevented from becoming dislodged rearward.

The front spring receiving sleeve 158, the front coil spring 155, the weight 153, the rear coil spring, the rear coil spring 157 and the rear spring receiving sleeve 159 of the dynamic vibration reducer 151 having the above-described construction are fitted onto the cylinder 141 from its rear end in this order before the cylinder 141 is mounted to the gear housing 107. Subsequently, the stopper ring 142 is fitted on the rear periphery of the cylinder 141, so that the dynamic vibration reducer 151 is prevented from becoming dislodged from the cylinder 141 and is thus integrated. Specifically, the dynamic vibration reducer 151 is mounted on the cylinder 141 in advance in order to form the dynamic vibration reducer assembly A1. In the form of this dynamic vibration reducer assembly A1, the rear end of the cylinder 141 is fitted into a cylindrical portion 107*a* of the gear housing 107 from the front, so that the dynamic vibration reducer 151 is mounted to the gear housing 107.

Further, the barrel part 108 is slipped over the cylinder 141 and the dynamic vibration reducer 151 from the front, and the rear end of the barrel part 108 is fitted on the cylindrical portion 107*a* of the gear housing 107. Then the barrel part 108 is connected to the gear housing 107 by means of a fastening means such as a screw 114. Thus, the dynamic vibration reducer 151 is arranged within a space having an annular section between the cylinder 141 and the barrel part 108. The barrel part 108 connected to the gear housing 107 has a stepped engagement portion 108*a* which is engaged with the outer surface of a front end circular portion 158*a* of the front spring receiving sleeve 158. Specifically, the front spring receiving sleeve 158 is disposed between the outer surface of the cylinder 141 and the inner surface of the barrel part 108 in contact with these outer and inner surfaces. Thus, the cylinder 141 and the barrel part 108 are positioned relative to each other in the radial direction, and more particularly, they are coaxially retained.

In front of the front spring receiving sleeve 158, an air vent 141*c* for idle driving prevention is formed through the cylinder 141 in the radial direction and an O-ring 146 is provided as a nonreturn valve to close the air vent 141*c* from radially outside. Under unloaded conditions in which the hammer bit 119 is not pressed against a workpiece, or in which no load is applied to the hammer bit 119, when the striker 143 performs a striking movement, air within the cylinder 141 is pressed forward by the striker 143 and then flows out through the air vent 141*c* while pushing the O-ring 146 aside. A small hole 158*b* extends through the front spring receiving sleeve 158 in the axial direction of the hammer bit, so that the air pushed out of the cylinder 141 by the striker 143 is led through the small hole 158*b* into a rear part of the annular space between the cylinder 141 and the barrel part 108. With this construction, the damper effect of air can be properly set by adjusting the diameter of the small hole 158*b*.

The weight 155 and the front and rear coil springs 155, 157 serve as vibration reducing elements in the dynamic vibration reducer 151 installed in the body 103 and cooperate to passively reduce vibration of the body 103 during operation of the hammer 101. Thus, the vibration caused in the body 103 of the hammer 101 can be alleviated or reduced.

Figure 5:
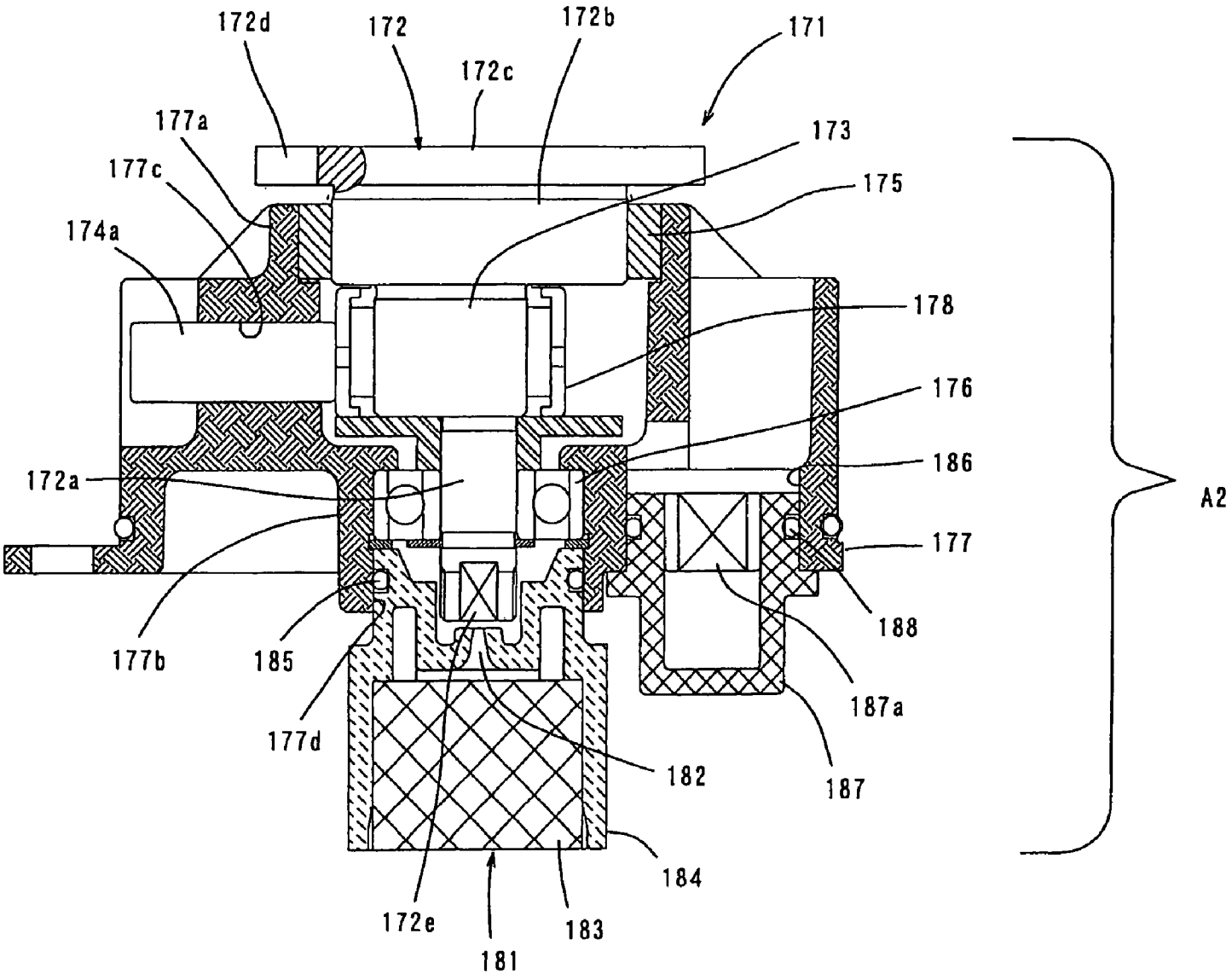
FIG. 5 is a sectional view of a vibration mechanism assembly.

The vibration mechanism 171 for actively driving the dynamic vibration reducer 151 is now explained. As shown in FIG. 2, the vibration mechanism 171 is disposed right below the crank shaft 121 and rearward of the dynamic vibration reducer 151. The vibration mechanism 171 mainly includes a cam shaft 172, a circular eccentric cam 173 that rotates together with the cam shaft 172, a power transmitting pin 174 that is caused to linearly move in the axial direction of the hammer bit by rotation of the eccentric cam 173 and drives the dynamic vibration reducer 151, bearings 175, 176 that rotatably support the cam shaft 172, and a bearing housing 177 that houses the bearings 175, 176. The eccentric cam 173 is integrally formed with the cam shaft 172, or it may be fixedly connected to the cam shaft 172, for example, by press fitting. As shown in FIG. 5, the vibration mechanism 171 is provided in the form of the vibration mechanism assembly A2 into which the above-mentioned component parts of the vibration mechanism 171 are assembled in advance. In the form of this vibration mechanism assembly A2, the vibration mechanism 171 is mounted to the gear housing 107 of the body 103 from below.

The cam shaft 172 of the vibration mechanism 171 has a small-diameter portion 172*a* underneath the eccentric cam 173, a large-diameter portion 172*b* on top of the eccentric cam 173, and a crank plate 172*c* on top of the large-diameter portion 172*b*. The cam shaft 172 is inserted into upper and lower bearing housing parts 177*a*, 177*b* of the bearing housing 177 from above. The small-diameter portion 172*a* and the large-diameter portion 172*b* are then rotatably supported by the bearing housing parts 177*a*, 177*b* via the bearings 175, 176. Thus, the cam shaft 172 is integrated with the bearing housing 177 via the bearings 175, 176. Further, a needle bearing 178 is fitted over the eccentric cam 173, so that wear of the eccentric cam 173 which may be caused by sliding contact with the power transmitting pin 174 can be prevented. Further, the crank plate 172*c* of the cam shaft 172 has an engagement portion 172*d* in the form of a U-shaped recess (or groove or slot) formed in a position displaced from its center. As shown in FIG. 3, when the vibration mechanism assembly A2 is mounted to the gear housing 107, the engagement portion 172*d* is engaged with a small-diameter projecting end 122*a* which is formed on the lower end of the eccentric pin 122 in the crank mechanism.

Figure 6:
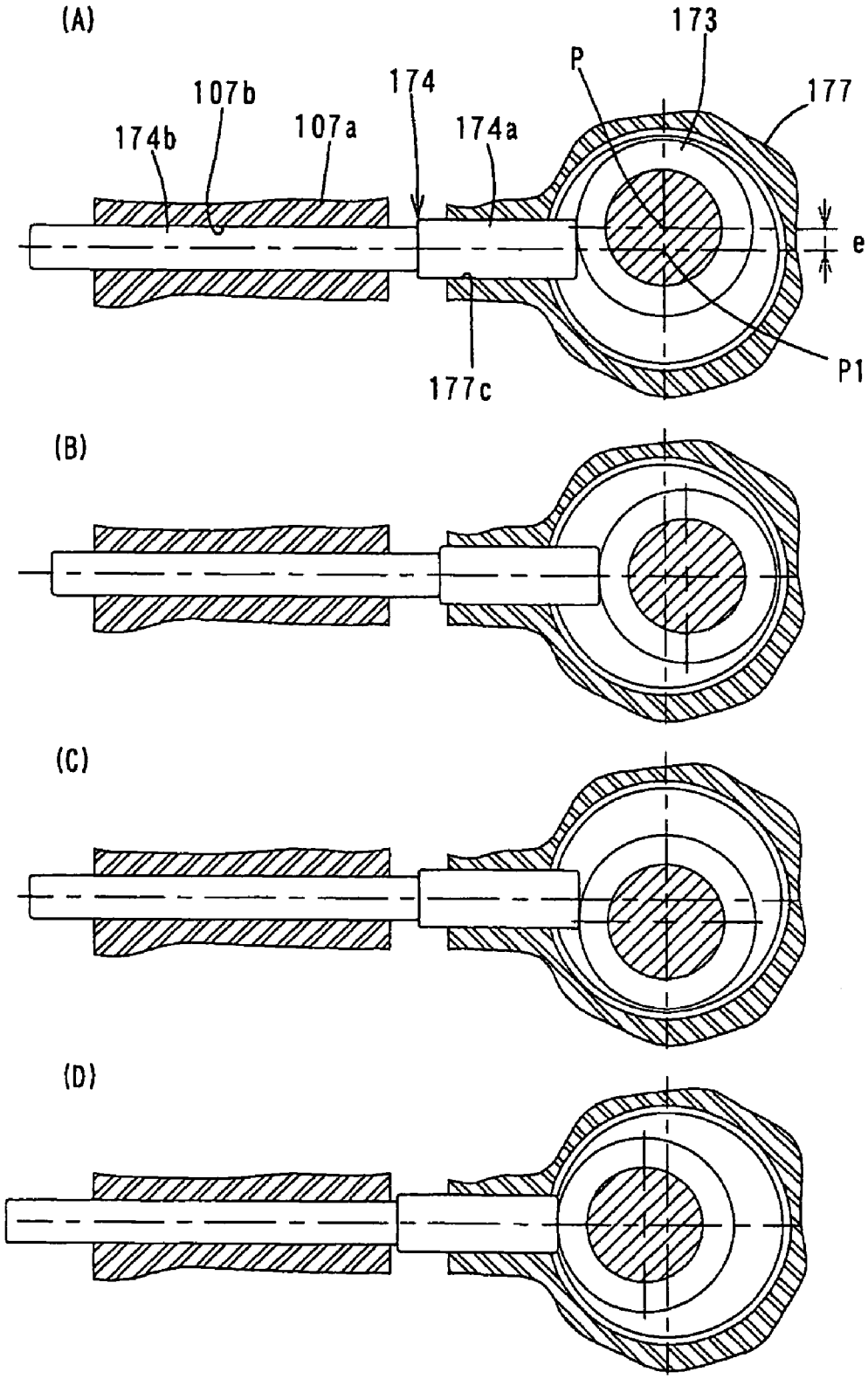
FIG. 6 is a view showing a power transmitting pin in detail.

The power transmitting pin 174 consists of front and rear pins 174*a*, 174*b* disposed in series in the axial direction of the hammer bit. One (rear) pin 174*a* in contact with the eccentric cam 173 (substantially with an outer ring of the needle bearing 178) is mounted to the bearing housing 177. The other (front) pin 174*b* is mounted to the cylindrical portion 107*a* of the gear housing 107. As shown in FIGS. 5 and 6, the one pin 174*a* adjacent to the eccentric cam 173 is slidably inserted into a pin guide hole 177*c* which extends through the bearing housing 177 in a direction transverse to the axis of the cam shaft 172 disposed in the bearing housing 177. The rear end surface of the pin 174*a* or its end in the direction of insertion is then placed into contact with the eccentric pin 173. Thus, the one pin 174*a* of the power transmitting pin 174 is fitted in the pin guide hole 177*c* of the bearing housing 177, and thus incorporated into the vibration assembly A2.

As shown in FIG. 6, the one pin 174*a* is designed to have a diameter at least twice as large as an eccentricity e of the eccentric cam 173 (distance between a center P of the eccentric cam 173 and a center P1 of its rotation) in order to ensure that the rear end surface of the pin 174*a* is always located on a line extending through the center P of the eccentric cam 173 in the axial direction of the hammer. FIGS. 6(A) to 6(D) show rotational movement of the eccentric cam 173 in 90-degree increments.

As shown in FIGS. 2 and 3, the other pin 174*b* remote from the eccentric cam 173 is inserted from the front into the pin guide hole 107*b* which extends through the cylindrical portion 107*a* of the gear housing 107 in the axial direction of the hammer bit. Thus the pin 174*b* is mounted in such a manner as to extend through the pin guide hole 107*b*. The other pin 174*b* is mounted into the pin guide hole 107*b* before the above-described dynamic vibration reducer assembly A1 is mounted to the gear housing 107. The front end surface of the other pin 174*b* is held in contact with the rear end surface of the rear spring receiving sleeve 159 of the dynamic vibration reducer 151 in the axial direction. The rear end surface of the other pin 174*b* is put into contact with the front end surface of the one pin 174*a* when the vibration mechanism assembly A2 is mounted to the gear housing 107. Further, the other pin 174*b* is designed to have the smallest possible diameter to the extent that adequate strength is ensured. Specifically, the other pin 174*b* is smaller in diameter than the one pin 174*a*. Thus, the cylindrical portion 107*a* on which the barrel part 108 is mounted and thus the barrel part 108 can be made smaller in diameter.

If the power transmitting pin 174 is formed by a single piece, the pin 174 may need to have a diameter of the one pin 174*a*. As a result, the cylindrical portion 107*a* and thus the barrel part 108 may increase in diameter. Therefore, according to this embodiment, by forming the power transmitting pin 174 from the two pins 174*a*, 174*b*, the barrel part 108 can be made smaller in diameter while maintaining the stability of movement of the power transmitting pin 174.

An air bleeding mechanism 181 for regulating pressure of the crank chamber 116 is fitted from below into the lower bearing housing part 177*b* of the bearing housing 177 through its lower end having an opening 177*d*. The air bleeding mechanism 181 includes a filter case 184 having an air passage 182 which provides communication between the inside and the outside of the crank chamber 116. The filter case 184 has a filter housing chamber, and a filter 183 is disposed within the filter housing chamber and serves to absorb lubricating oil in order to prevent lubricating oil from leaking out of the crank chamber 116 through the air passage 182. The filter case 184 is removably mounted to the opening 177*d* of the lower bearing housing part 177*b* by fitting into it from below and held in the fitted position by friction of a sealing O-ring 185 which is disposed between the mating surfaces in the fitted position. In this embodiment, the filter case 184 for air bleeding is mounted right below the cam shaft 172, and at least an inner opening of the air passage 182 is arranged on the axis of the cam shaft 172. Therefore, entry of lubricating oil from the crank chamber 116 into the air passage 182 can be prevented by centrifugal force which is caused by rotation of the cam shaft 172, so that leakage of lubricating oil can be reduced.

Further, an oil filler port 186 for supplying lubricating oil (grease) into the crank chamber 116 is formed in the bearing housing 177. A filler port cap 187 for closing the oil filler port 186 is removably mounted to the oil filler port 186 by fitting into it from below and held in the fitted position by friction of a sealing O-ring 188 which is disposed between the mating surfaces in the fitted position.

As described above, the vibration mechanism assembly A2 includes not only the vibration mechanism 171 but also the air bleeding mechanism 181 and the filler port cap 187. The vibration mechanism assembly A2 having such a construction is inserted from below into a circular mounting opening 107*c* which is formed in the bottom of the gear housing 107 on the side opposite to the crank mechanism. Thus, the vibration mechanism assembly A2 is disposed within the crank chamber 116 of the gear housing 107. In this state, the bearing housing 177 is fastened to the gear housing 107 by means of a fastening means such as a screw 189.

Provided that the crank mechanism is already mounted to the gear housing 107 before the vibration mechanism assembly A2 is mounted to the gear housing 107, in order to mount the vibration mechanism assembly A2 to the gear housing 107, the engagement portion 172*d* formed in the crank plate 172*c* of the cam shaft 172 needs to be positioned so as to be engaged with the projecting end 122*a* of the eccentric pin 122 formed on the crank plate 124 in the crank mechanism. In other words, adjustment of the circumferential position of the cam shaft 172 is required in order to mount the vibration mechanism assembly A2 to the gear housing 107.

Therefore, in this embodiment, a square shank (width across bolt) 172*e* is formed on the lower end of the cam shaft 172, and a square hole 187*a* is provided in an end of the filler port cap 187 in the direction of insertion and shaped to correspond to the contour of the square shank 172*e*. The positional adjustment of the cam shaft 172 is naturally performed before the filter case 184 is mounted to the opening 177*d* of the lower bearing housing part 177*b*. The filler port cap 187 is dimensioned such that it can be inserted into the opening 177*d* of the bearing housing part 177*b* and turned.

Therefore, by making positional adjustment of the cam shaft 172 in the circumferential direction by using the filler port cap 187, the engagement portion 172*d* of the crank plate 172*c* can be easily engaged with the projecting end 122*a* of the eccentric pin 122 of the cam shaft 172. As a result, the cam shaft 172 can rotate together with the crank shaft 121. Further, when the vibration mechanism assembly A2 is mounted to the gear housing 107, the cam shaft 172 is substantially coaxially disposed with the crank shaft 121 of the crank mechanism.

Further, the vibration mechanism assembly A2 is covered with a covering member 191 which is mounted to the gear housing 107 in order to close the opening 107*c* in the bottom of the gear housing 107. The covering member 191 presses and holds the filter case 184 and the filler port cap 187 of the vibration mechanism assembly A2 from below. The covering member 191 further extends to a lower region of the motor housing 107 disposed at the rear of the gear housing 107. Thus, the covering member 191 also covers the lower region and presses and holds the lower bearing housing part 105*a* of the motor housing 107 from below. The covering member 191 is fastened to the gear housing 107 by screws which are not shown.

In the electric hammer 101 having the above-described construction, when the crank mechanism is driven by driving the driving motor 111, the cam shaft 172 of the vibration mechanism 171 rotates together with the crank shaft 121 of the crank mechanism. The rotation of the cam shaft 172 is converted into linear motion via the eccentric cam 173 and the power transmitting pin 174 and then inputted to the dynamic vibration reducer 151. Thus, the weight 153 is forcibly driven in the axial direction of the hammer bit via the rear spring receiving sleeve 159 and the rear coil spring, so that the dynamic vibration reducer 151 is caused to perform a vibration reducing function. Specifically, the dynamic vibration reducer 151 serves not only as a passive vibration reducing mechanism as described above, but as an active vibration reducing mechanism by forced vibration in which the weight 153 is actively driven. Therefore, vibration caused in the body 103 during hammering operation can be further effectively reduced According to this invention, component parts of the dynamic vibration reducer 151, i.e. the weight 153, the front and rear coil springs 155, 157 and front and rear spring receiving sleeves 158, 159, are mounted on the cylinder 141 in advance in order to form the dynamic vibration reducer assembly A1. In the form of this dynamic vibration reducer assembly A1, the dynamic vibration reducer 151 is mounted to the gear housing 107. Thus, the dynamic vibration reducer 151 can be handled as one part integrated with the cylinder 141, so that mounting operation to the gear housing 107 is facilitated and ease of assembly is increased. Further, removal from the gear housing 107 is also facilitated so that ease of repair is increased.

In this embodiment, also as for the vibration mechanism 171 for actively driving the dynamic vibration reducer 151, its component parts, i.e. the cam shaft 172, the eccentric cam 173, the bearings 175, 176 and the pin 174*a*, are mounted to the bearing housing 177 in advance in order to form the vibration mechanism assembly A2. In the form of this vibration mechanism assembly A2, the vibration mechanism 171 is mounted to the gear housing 107. Thus, the vibration mechanism 171 can be handled as one part, so that the mounting operation to the gear housing 107 is facilitated and ease of assembly is increased. Further, removal from the gear housing 107 is also facilitated so that ease of repair is increased.

Further, in this embodiment, component parts of the dynamic vibration reducer 151 are mounted onto the cylinder 141 in advance in order to form the dynamic vibration reducer assembly A1, but they may be mounted not to the cylinder 141 but to the barrel part 108. Further, in this embodiment, the electric hammer is described as being of the type in which the driving motor 111 is arranged such that the axis of the motor shaft 112 crosses the axis of the hammer bit. However, the present invention can also be applied to electric hammers of the type in which the driving motor 111 is arranged such that the axis of the motor shaft 112 does not cross the axis of the hammer bit. Further, in this embodiment, the electric hammer is described as a representative example of the impact tool, but the present invention can also be applied to a hammer drill in which the hammer bit 119 can perform a striking movement and a rotation.

Figure 10:
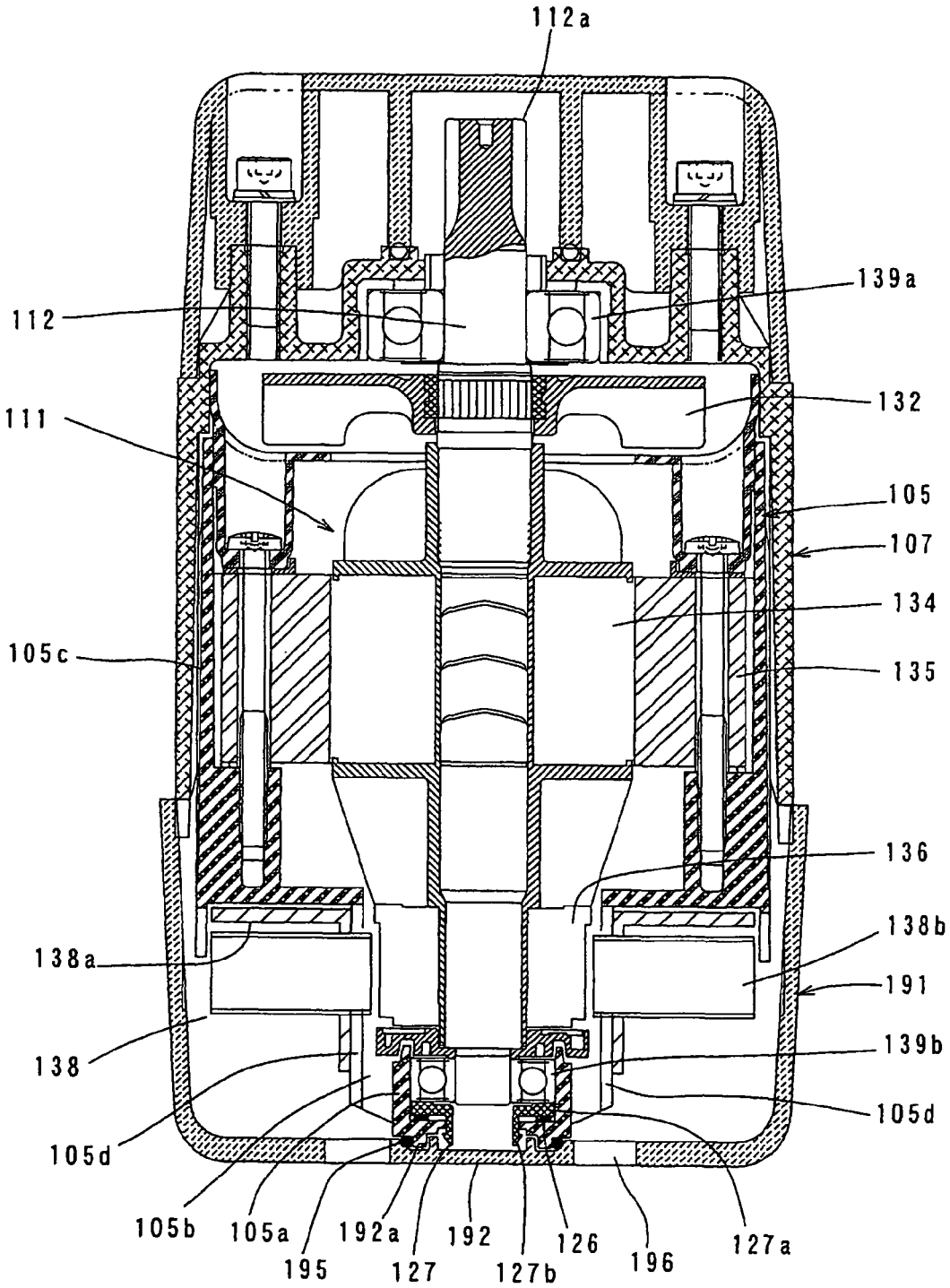
FIG. 10 is a sectional view taken along line A-A in FIG. 1.

FIG. 10 shows the driving motor 111 in detail. As shown, the driving motor 111 mainly includes a motor shaft 112, a centrifugal cooling fan 132 that is disposed on the upper end of the motor shaft 112 and rotates together with the motor shaft 112, an armature 134 that rotates together with the motor shaft 112, a stator 135 fixed to the motor housing 105, a commutator 136 disposed on the lower end of the motor shaft 112 (on the side opposite to the cooling fan 132), and a brush holder unit 138 that houses a plurality of (two) carbon brushes (not shown) disposed for supplying electric current in sliding contact with the outer periphery of the commutator 136. Both axial ends of the motor shaft 112 are rotatably supported by the motor housing 105 via lower and upper bearings 139*a*, 139*b*. The motor shaft 112, the armature 134 and the commutator 136 form a rotor.

Figure 7:
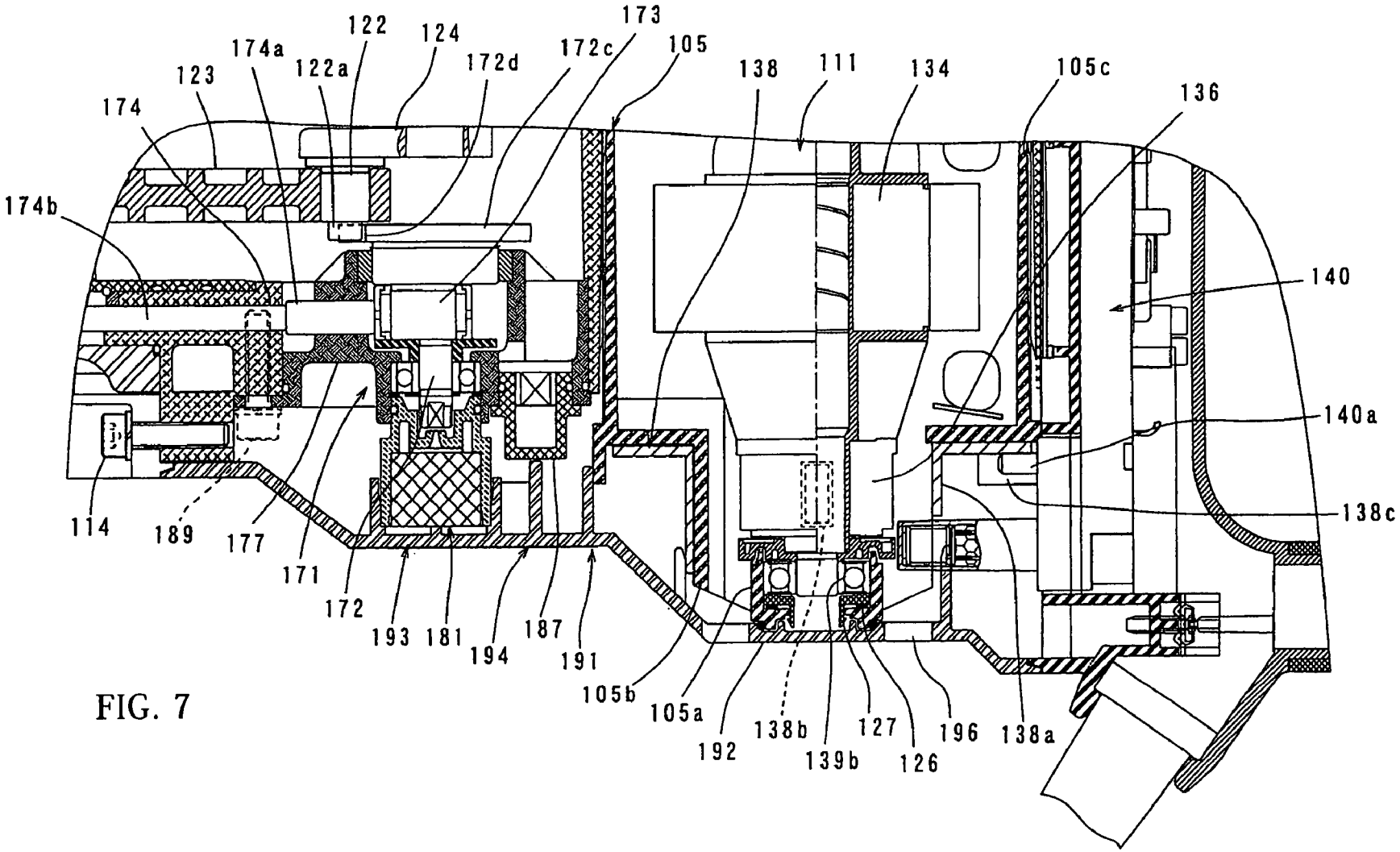
FIG. 7 is a partially enlarged view of FIG. 2.

As shown in FIG. 7, the brush holder unit 138 is an assembly formed by mounting a plurality of component parts, including a brush holder 138*b* that holds at least the carbon brushes, a female terminal 138*c* that is connected to a male terminal 140*a* of a controller 140 for controlling the driving motor 111, and a terminal (not shown) connected to the rotor side, on a generally cylindrical holder base 138*a* in advance. The brush holder unit 138 is disposed outside the motor housing 105 in a position corresponding to the outer peripheral region of the commutator 136. In other words, the brush holder unit 138 is disposed outside a connecting region 105*b* of the motor housing 105 between a large-diameter body region 105*c* for housing the armature 134 and the stator 135 and a lower bearing housing part 105*a* for housing a lower bearing 139*b*. In order to mount the brush holder unit 138 on the connecting region 105*b*, the holder base 138 is fitted over the connecting region 105*b* from below the motor housing 105 and fastened to the connecting region 105*b* by screws (not shown). Further, in order to avoid interference of the connecting region 105*b* with the brush holder 138*b* which extends through the connecting region 105*b* in the radial direction and faces the outer periphery of the commutator 134, a notch 105*d* is formed in the connecting region 105*b* and has a predetermined length extending upward from the lower end of the connecting region 105*b*.

Further, a wave washer 126 is disposed between the bearing housing part 105*a* and an axial rear end face of the bearing 139*b* within the bearing housing part 105*a* and exerts a spring force on the bearing 139*b* in the axial direction of the bearing 139*b*. If it is constructed such that the wave washer 126 is disposed simply by inserting into the bearing housing space of the bearing housing part 105*a*, when the motor housing 105 is oriented upward (with the bearing housing part 105*a* side up), for example, in order to mount the driving motor 111 into the motor housing 105, the wave washer 126 may fall out of the bearing housing part 105*a*, which causes inconvenience in handling.

In view of this problem, in this embodiment, a washer retaining ring 127 is provided for retaining the wave washer 126 so as to prevent the wave washer 126 from falling out of the bearing housing space. The washer retaining ring 127 is a cylindrical member having a flange 127*a* on its upper end and an engagement claw 127*b* on its lower end. The engagement claw 127*b* is engaged with the edge of an opening formed in the bottom of the bearing housing part 105*a*, so that the washer retaining ring 127 is mounted to the bearing housing part 105*a* and can move in the axial direction with respect to the bearing housing part 105*a*. The amount of this relative movement is designed to be larger than at least the amount of elastic deformation of the wave washer 126. The washer retaining ring 127 retains the wave washer 126 by holding it between the upper end flange 177*a* and the bottom of the bearing housing part 105*a*. Thus, the wave washer 126 is retained in the bearing housing part 105*a* and thus prevented from falling out. Therefore, ease of assembly in mounting the driving motor 111 into the motor housing 105 can be improved.

A generally circular motor installation space having an open bottom is formed at the rear of the crank chamber 116 within the gear housing 107. As shown in FIG. 2, the motor housing 105 with the driving motor 111 mounted therein is inserted with the cooling fan 132 side up into the motor installation space from below and connected to the gear housing 107 by screws (not shown). Thus, the bearing housing part 105*a* that houses the lower bearing 139*b* of the driving motor 111, the brush holder unit 138, the vibration mechanism 171, the air bleeding mechanism 181 and the filler port cap 187 are arranged below the gear housing 107 in an exposed state. Therefore, a covering member 191 is disposed over the bottom of the gear housing 107 in such a manner as to substantially entirely cover the bottom of the gear housing 107 including the above-mentioned exposed members.

The covering member 191 has a generally rectangular dish-like shape and is removably fastened to the gear housing 107 by a plurality of screws which are not shown. In this fastened state, as shown in FIG. 2, the covering member 191 presses and holds the lower bearing housing part 105*a*, the filter case 184 of the air bleeding mechanism 181 and the filler port cap 187 from below. For this purpose, a first retaining part 192 for retaining the bearing housing part 105*a*, a second retaining part 193 for retaining the filter case 184 and a third retaining part 194 for retaining the filler port cap 187 are formed on the inside of the covering member 191.

As shown in FIG. 10, the first retaining part 192 is formed by an annular recess 192*a*. An outer edge of the recess 192*a* is elastically engaged with a lower edge of the bearing housing part 105*a* via an O-ring 195. As a result, the first retaining part 192 presses the bearing housing part 105*a* radially inward while pressing it in the axial direction from below, so that it retains the bearing housing part 105*a*. Specifically, the recess 192*a* and the bearing housing part 105*a* are engaged with each other via their respective inclined or curved surfaces, so that axial components and radial components of the pressing force act upon the bearing housing part 105*a*.

Figure 8:
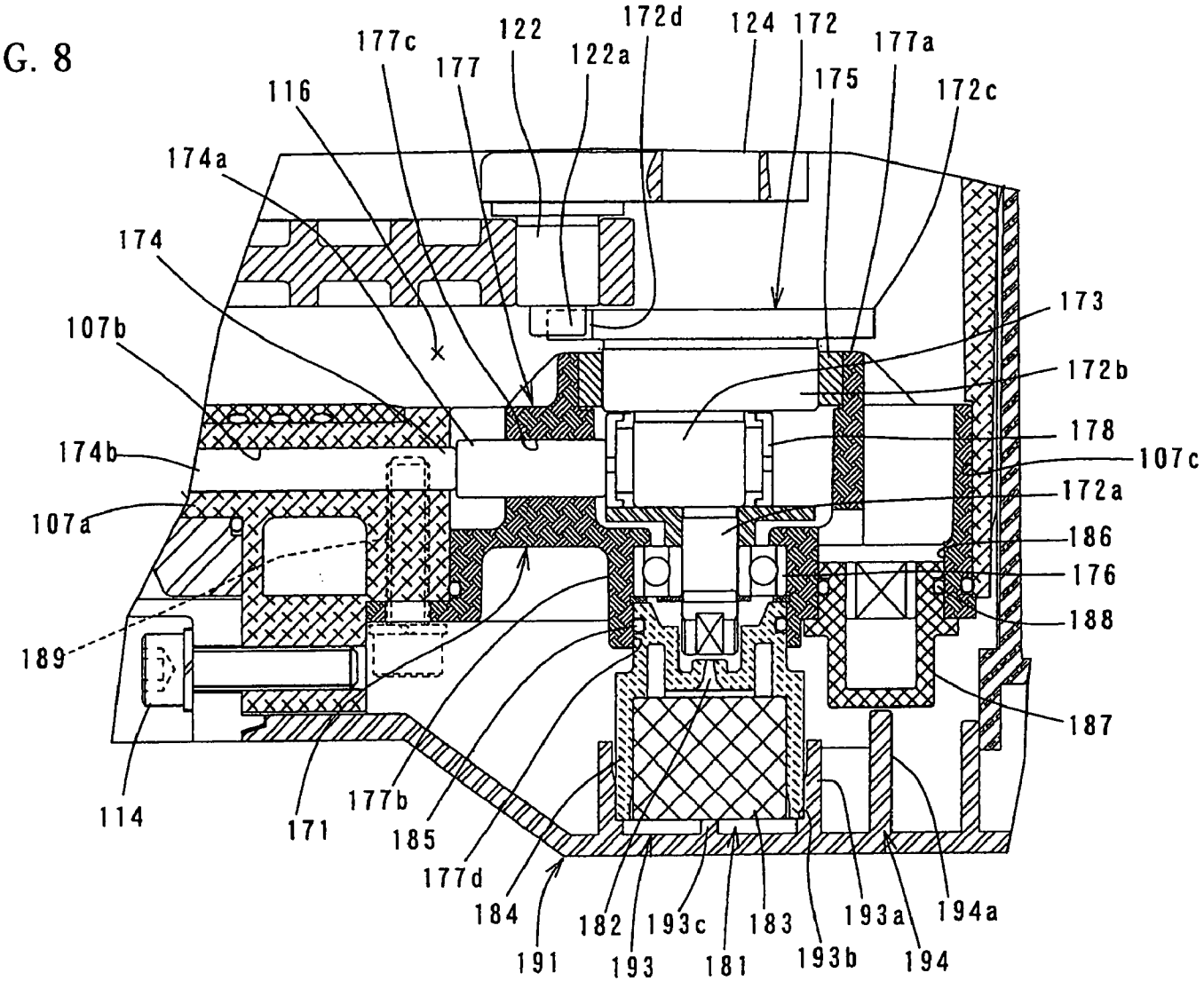
FIG. 8 is a partially enlarged view of FIG. 7.

As shown in FIG. 8, the second retaining part 193 is formed by a generally cup-shaped cylindrical part 193*a* having an open top and integrally protruding upward from the bottom (inner surface) of the covering member 191. The cylindrical part 193*a* is fitted over the filter case 184 from below. Further, a stepped end surface 193*b* is formed in the circumferential wall surface of the cylindrical part 193*a* above the bottom and extends along the circumferential direction, and presses the axial lower end surface of the filter case 184 from below in the axial direction. Thus, the second retaining part 193 retains the filter case 184. Further, a cross-shaped stopper 193*c* is formed in the bottom of the cylindrical part 193*a* and is placed in contact with the lower surface of the filter 183. As a result, a predetermined space as an oil reservoir is defined between the lower surface of the filter 183 and the bottom of the cylindrical part 193*a*. Therefore, even if lubricating oil passes through the filter 183, the lubricating oil can be retained in the oil reservoir and prevented from leaking to the outside.

As shown in FIG. 8, the third retaining part 194 is formed by a protrusion 194*a* integrally protruding upward from the bottom of the covering member 191. The protrusion 194*a* presses the center of a lower end surface of the filler port cap 187 from below in the axial direction, so that the third retaining part 194 retains the filler port cap 187.

In the embodiment having the above-described construction, the covering member 191 has not only a function of covering various internal mechanisms housed within the gear housing 107, but a function of retaining some of the component parts of the internal mechanisms, i.e. the bearing housing part 105*a*, the air bleeding mechanism 181 and the filler port cap 187. As described above, in the construction in which the driving motor 111 is provided with the brush holder unit 138, the connecting region 105*b* between the body region 105*c* and the bearing housing part 105*a* of the motor housing 105 is designed to have a smaller outside diameter in order to install the brush holder unit 138 thereon and designed to have the notch 105*d* in order to allow the brush holder 138*b* to face the commutator 136. For such reasons, the connecting region 105*b* may be reduced in strength.

Therefore, according to this invention, the construction in which the covering member 191 retains the bearing housing part 105*a* by pressing it in the axial and radial directions can compensate for insufficient strength of the connecting region 105*b*. As a result, runout of the motor shaft 112 can be prevented. Further, the construction in which the bearing housing part 105*a* is elastically retained via the O-ring 195 has a dust prevention effect on the bearing 139*b* and an effect of preventing abnormal noise (chatter) from being caused by contact between the covering member 191 and the bearing housing part 105*a* due to vibration. Further, in this embodiment, the bearing housing part 105*a* is retained by pressing from radially outside, but it may be constructed such that it is retained by pressing from radially inside.

Further, with the construction in which the air bleeding mechanism 181 and the filler port cap 187 are pressed and retained by the covering member 191, additional means for preventing the air bleeding mechanism 181 and the filler port cap 187 from falling out due to vibration or other causes are not required. Further, by detaching the covering member 191 from the gear housing 107, for example, for replacement of the carbon brushes, replacement of the air bleeding filter 173 and supply of lubricating oil can also be made at the same time, so that ease of use can be enhanced.

Figure 9:
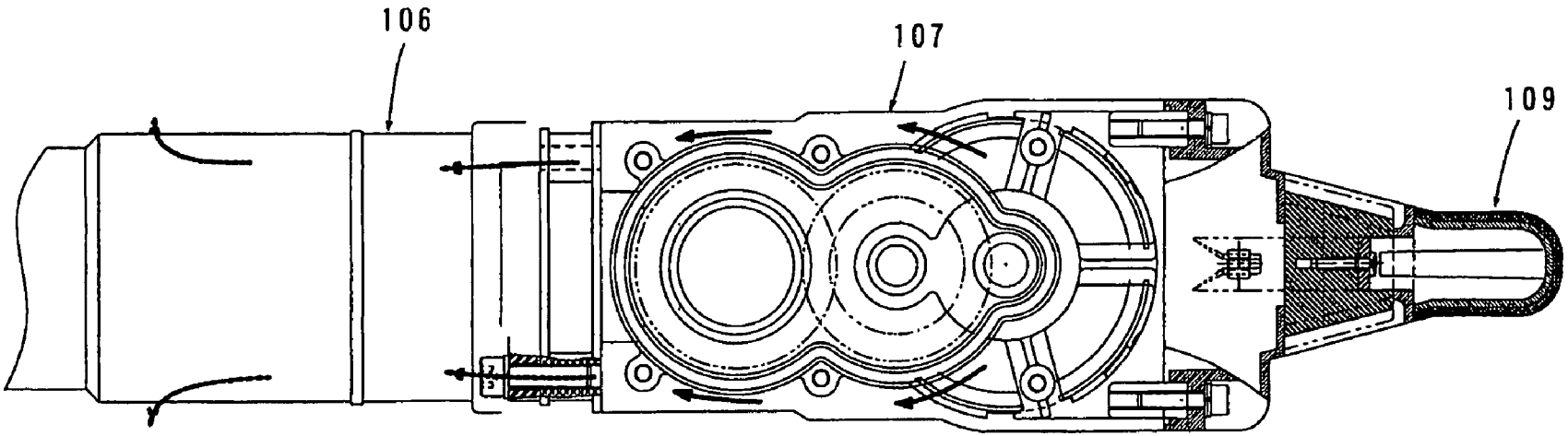
FIG. 9 is a plan view, partly in section, showing the entire electric hammer.

Further, as shown in FIGS. 2 and 10, an inlet 196 for taking in outside air for cooling the driving motor 111 is formed in the covering member 191 around the first retaining part 192 that serves to retain the bearing housing part 105. When the driving motor 111 is driven, outside air is taken into the motor hosing 105 through the inlet 196 by rotation of the cooling fan 132. The outside air then passes between the armature 134 and the stator 135 and between the stator 135 and a housing inner wall surface and thus cools the driving motor 111. In this embodiment, a cooling air passage is provided such that air used for cooling the motor can be further used to cool the reduction gear mechanism 161, the crank mechanism and the striking mechanism 115. Flow of the cooling air is shown by arrows in FIGS. 1 and 9.

Specifically, in the electric hammer 101, air used for cooling the motor is led into a space 106*a* between the gear housing 107 and a body cover 106 which covers the outside of the gear housing 107, through an upper opening of the motor housing 105 by the cooling fan 132. Then the air flows forward through a space 106*b* between the barrel part 108 and the body cover 106 which covers the outside of the barrel part 108, and then, the air is discharged to the outside of the tool via outlets 106*c* (shown by a broken line in FIGS. 1 and 2) formed in the right and left side surfaces of the body cover 106. The air passage is provided to allow this air flow. In this manner, air flowing through the air passage cools the reduction gear mechanism 161 within the gear chamber 117 of the gear housing 107, the crank mechanism within the crank chamber 116, and the cylinder 141 and the striking mechanism 115 within the barrel part 108. Thus, all of the heating-producing components in the hammer 101 can be efficiently cooled.

Figure 11:
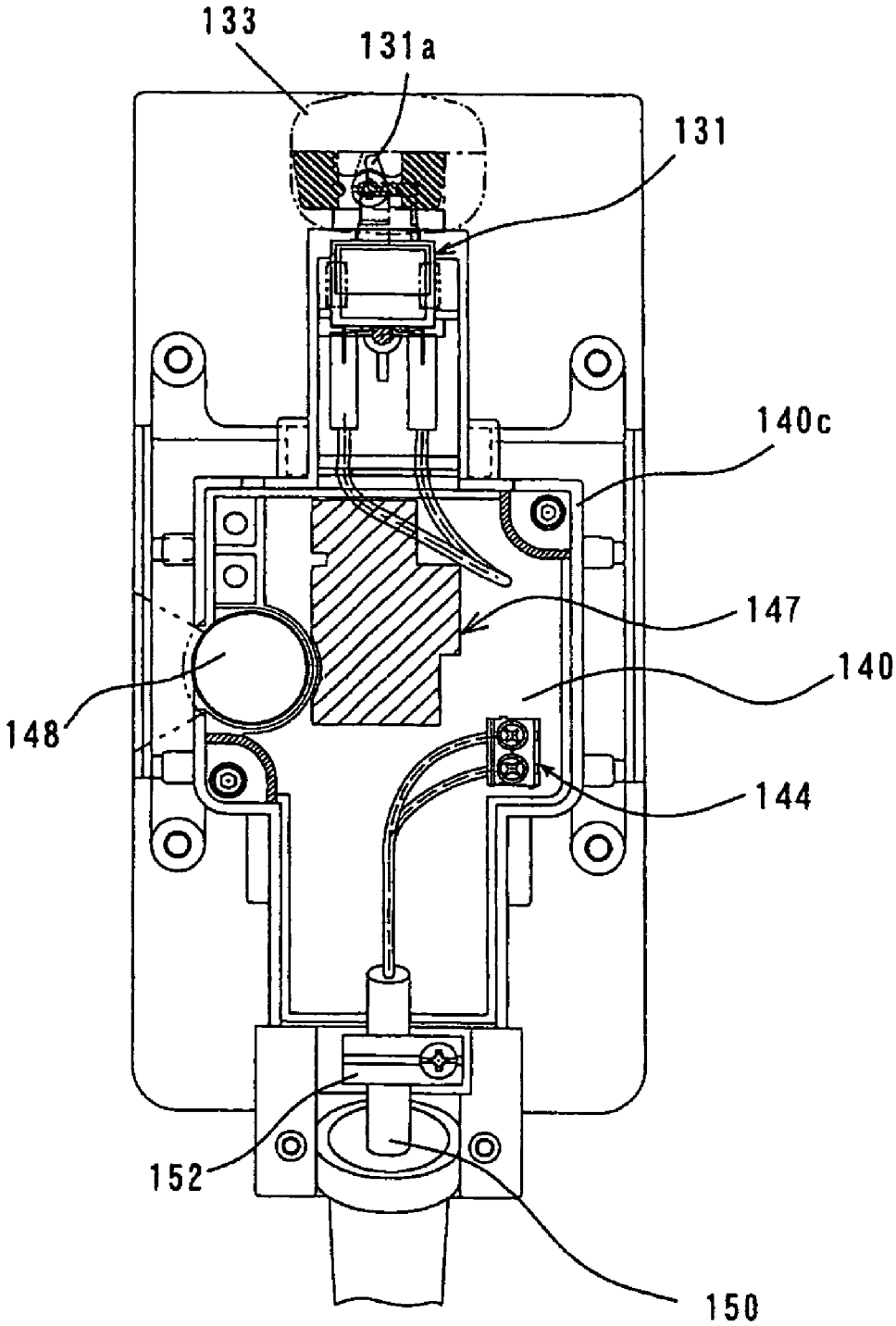
FIG. 11 shows a controller 140 in FIG. 1 as viewed from the handgrip 109 side.
Figure 12:
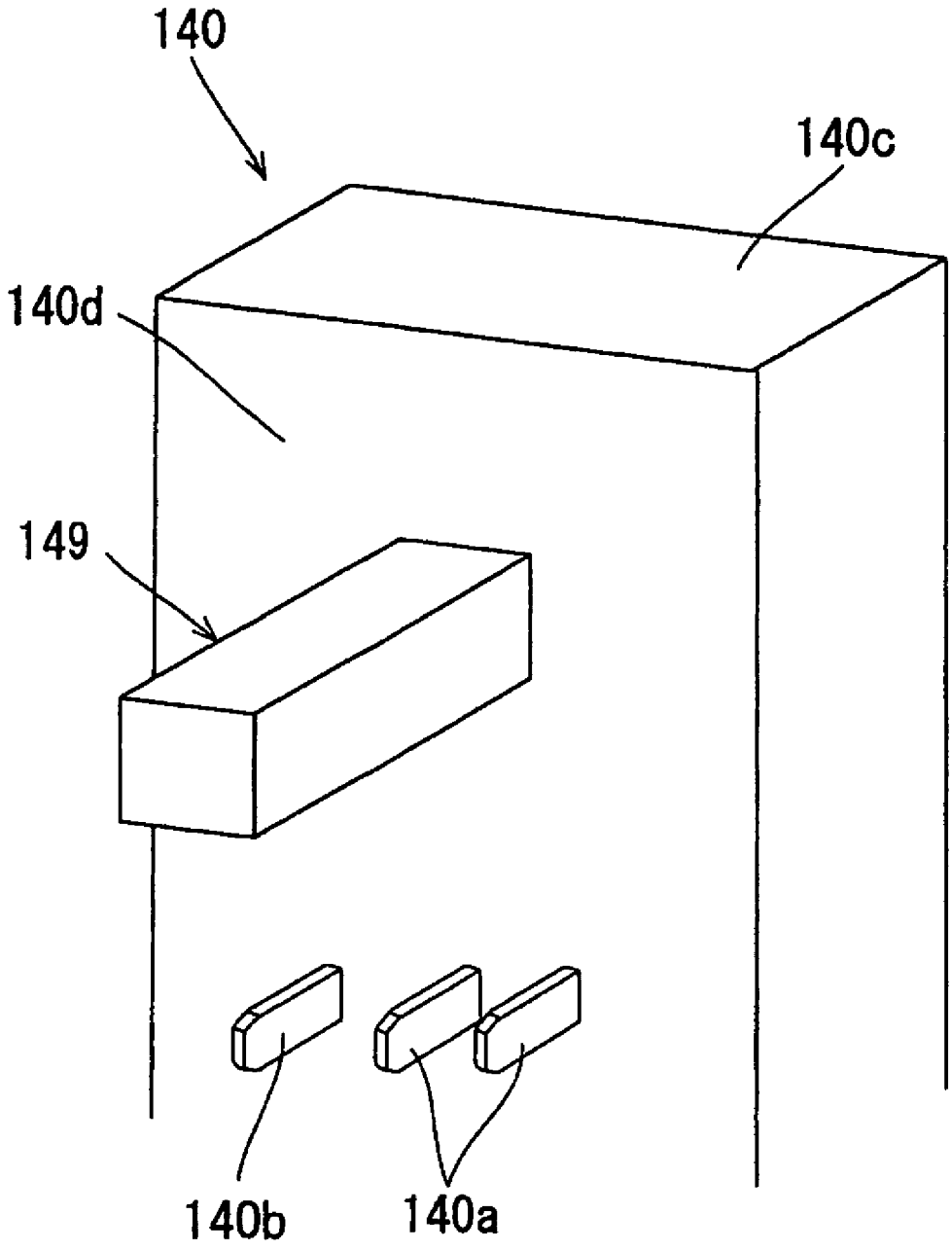
FIG. 12 shows a controller housing 140*c* of the controller 140 in FIG. 11 as viewed from the body 103 side.

A controller 140 and its peripheral structure in this embodiment is now explained with reference to FIGS. 11 and 12. FIG. 11 shows the controller 140 in FIG. 1 as viewed from the handgrip 109 side, and FIG. 12 shows a controller housing 140*c* of the controller 140 in FIG. 11 as viewed from the body 103 side.

The controller 140 in this embodiment is disposed at the rear of the body 103 between the body 103 and the handgrip 109 to be held by the user. The handgrip 109 forms the "handle" according to this invention. As shown in FIG. 11, the controller 140 is formed by housing or mounting various electrical components (members) in a controller housing 140*c*. In other words, the controller 140 is also referred to as an electrical component assembly in which various electrical components are integrally mounted to the controller housing 140*c* in advance. The controller housing 140*c* can be appropriately formed by one or more parts. The controller housing 140*c* is preferably configured as a housing member or casing of a box-like shape having a bottom. With such construction, the electrical components can be housed and mounted in a housing space within the housing member or casing, so that the electrical components can be reliably protected. The controller 140 and the controller housing 140*c* are the features that correspond to the "electrical component assembly" and the "housing", respectively, according to this invention.

In this embodiment, the electrical components mounted in advance in the controller housing 140*c* of the controller 140*c* specifically includes an AC cord 150 for AC power supply, an AC terminal 144, a power switch 131, a control unit 147, male terminals 140*a*, 140*b* of the controller 140 for controlling the driving motor 111, a rotation speed control dial 148 and a motor speed sensor 149. The electrical component assembly in this embodiment is based on a controller that houses the control unit 147 for the driving motor 111 and formed as an assembly by additionally mounting other electrical components together with the controller. Therefore, in this embodiment, this controller-based electrical component assembly is referred to as the controller 140 in this embodiment.

The AC cord 150 is a power cord for introducing AC power into the controller 140 and is a feature that corresponds to the "power cord" according to this invention. The AC cord 150 itself is mounted and retained on the controller housing 140*c*. Specifically, as shown in FIG. 6, the AC cord 150 is placed in between the controller housing 140*c* and a cord clamp 152 so that it is fixed and retained. As for retaining of the AC cord itself, the AC cord 150 may be directly retained on the controller housing 140*c*, or it may be indirectly retained on the controller housing 140*c* via an intervening member such as a cord guard disposed between the AC cord 150 and the controller housing 140*c*. The AC terminal 144 is a terminal to which one end of the AC cord 150 having the other end connected to the AC power is connected. The terminal 144 is a feature that corresponds to the "power terminal to which a power cord is connected" according to this invention.

The power switch 131 can be switched between the on position in which power inputted via the AC cord 150 is supplied to a motor circuit of the driving motor 111 and the off position in which the power supply is cut off. The power switch 131 is a feature that corresponds to the "power switch" according to this invention. The control unit 147 performs controls relating to power supply to the driving motor 111. Specifically, it has a function of controlling electric current to be passed through the motor circuit of the driving motor 111 based on the settings of the rotation speed control dial 148 on which the rotation speed (number of revolutions) of the driving motor 111 can be set. In the control unit 147, an output part that outputs control signals relating to motor speed control to the driving motor 111 may also have a function as an output part that outputs control signals relating other than motor speed control, or the output parts may be separately independently provided. The control unit 147 is a feature that corresponds to the "control unit" according to this invention.

As shown in FIG. 12, the motor speed sensor 149 is a detector sensor that is formed on an opposed surface 140*d* of the controller housing 140*c* which is opposed to the rear of the body 103 and extends toward a rotor of the driving motor 111. The motor speed sensor 149 can detect information relating to rotation speed of the driving motor 111 (rotor) and is a feature that corresponds to the "motor speed sensor" in this invention. Further, a pair of male terminals 140*a* for feeding electric current controlled by the control unit 147 to the brush holder

138*b*, and a male terminal 140*b* for detecting carbon life are provided on the opposed surface 140*d* of the controller housing 140*c*.

The pair terminals 140*a* and the terminal 140*b* are configured as plug-in type terminals or male terminals (projections) which are inserted into a female terminal 138*c* (recess) formed in the brush holder 138*b* for terminal connection. For the terminal connection of the male terminals 140*a*, 140*b*, the male terminals 140*a*, 140*b* are plugged into the female terminal 138*c* formed in the rear of the body 103 in a direction transverse to the motor shaft 112 of the driving motor 111. The male terminals 140*a*, 140*b* on the controller 140 side and the female terminal 138*c* on the body 103 side are features that correspond to the "connecting terminal" and the "connected terminal", respectively, according to this invention. Further, the terminal 140*b* for detecting carbon life may be omitted as necessary. Moreover, a female terminal may be provided on the controller 140 side and a male terminal may be provided on the brush holder 138*b* side.

With the controller 140 having the above-described construction, various electrical components installed in the controller housing 140*c* can be handled as one part in the form of the electrical component assembly. Further, the electrical components can be easily mounted to the body 103 side in one operation by plug-in terminal connection between the connecting terminal and the connected terminal. Therefore, ease of mounting the electrical components of the controller 140 can be improved.

Figure 13:
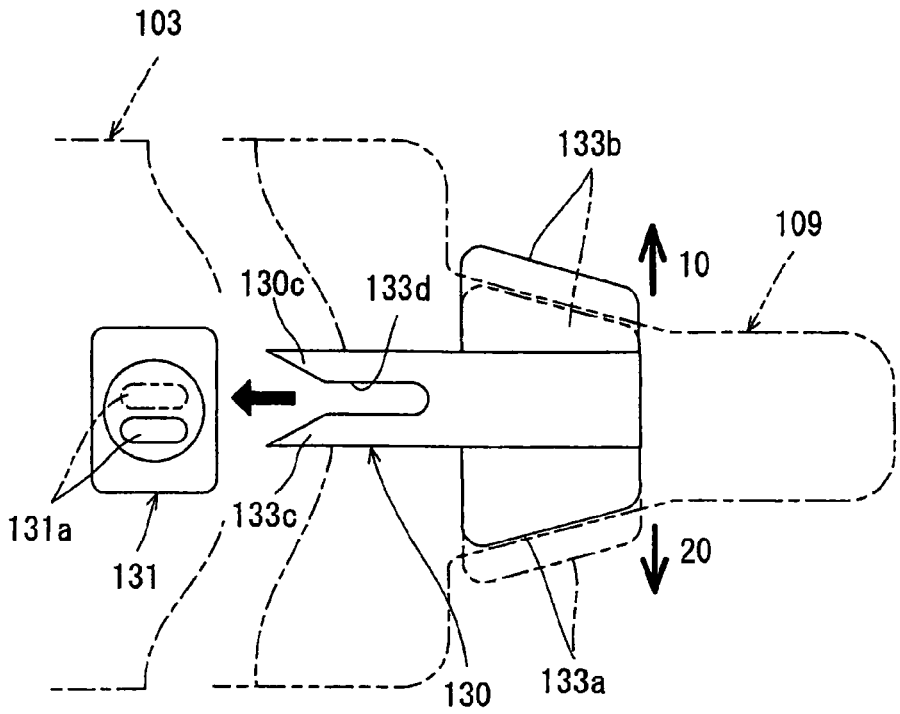
FIG. 13 is a top view schematically showing the controller 140 and the handgrip 109 as viewed from above, in the state in which the handgrip 109 is not yet mounted to the body 103.
Figure 14:
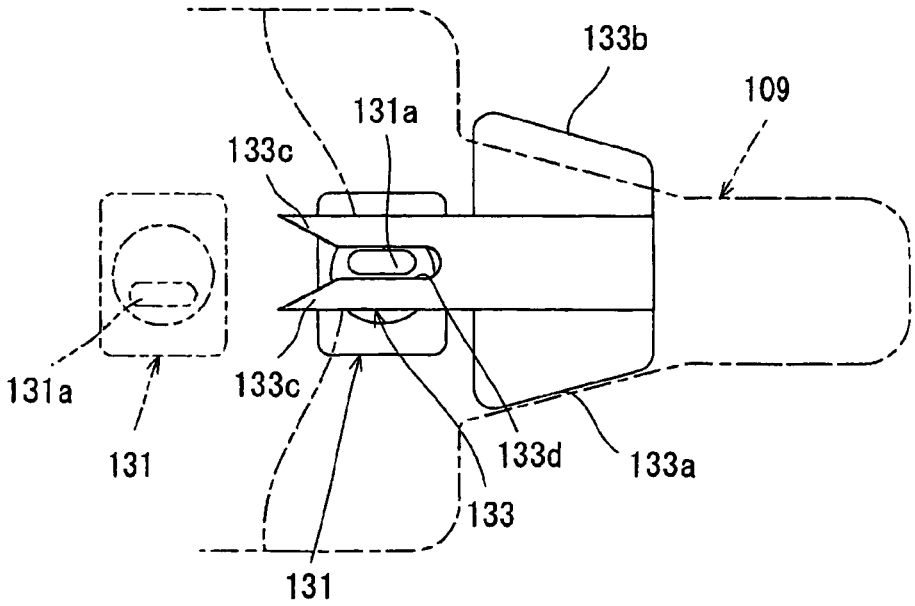
FIG. 14 is also a top view schematically showing the controller 140 and the handgrip 109 as viewed from above, in the state in which the handgrip 109 is already mounted to the body 103 from the controller 140 side.

In this embodiment, after the controller 140 is mounted to the body 103, the handgrip 109 is further mounted to the body 103 from the controller 140 side. The construction and operation of mounting the handgrip 109 is specifically described with reference to FIGS. 13 and 14. FIG. 13 is a top view schematically showing the controller 140 and the handgrip 109 as viewed from above, in the state in which the handgrip 109 is not yet mounted to the body 103. FIG. 14 is also a top view schematically showing the controller 140 and the handgrip 109 as viewed from above, in the state in which the handgrip 109 is already mounted to the body 103 from the controller 140 side.

As shown in FIG. 13, in the power switch 131 in this embodiment, a switch lever 131*a* can be actuated between the on position shown by a solid line and the off position shown by a dotted line. Electric current is passed through the motor circuit of the driving motor 111 when the switch lever 131*a* is placed in the on position, while the passage of electric current through the motor circuit of the driving motor 111 is cut off when the switch lever 131*a* is placed in the off position.

An operating member 133 is provided on the handgrip 109 and can be slid in the direction of an arrow 10 or the direction of an arrow 20 in FIG. 13 by manual operation of the user. The operating member 133 has a first operation region 133*a* that is pressed in order to place the switch lever 131*a* in the off position and a second operation region 133*b* that is pressed in order to place the switch lever 131*a* in the on position. Specifically, the operating member 133 is slid into the off position (shown by a solid line in FIG. 13) by pressing the first operation region 133*a*, while it is slid into the on position (shown by a dotted line in FIG. 13) by pressing the second operation region 133*b*. Further, the operating member 133 has a pair of guides 133*c* each formed on its tip end and having an inclined surface and also has a slit 133*d* between the guides 133*c*. The switch lever 131*a* can be switched between the on position and the off position according to the sliding operation of the operation member 133 when the switch lever 131*a* is held in the slit 133*d*.

In such a construction, the operation member 133 has a function of matching the set position of the switch lever 131*a* with the set position of the operation member 133 by cooperation of the pair guides 133*c* and the slit 133*d*. This is now specifically considered as to the case in which the handgrip 109 is to be mounted to the body 103 from the controller side as shown in FIG. 14, for example, in the state in which the switch lever 131*a* is placed in the on position shown by the solid line in FIG. 13 and the operation member 133 is placed in the off position shown by the solid line in FIG. 13. When the load required to switch the operation member 133 between the on position and the off position is heavier than the load required to switch the switch lever 131*a* between the on position and the off position, the switch lever 131*a* is guided into the slit 133*d* while sliding on the inclined surface of one of the guide 133*c* of the operation member 133. Thus, the switch lever 131*a* is switched from the on position to the off position, so that the set position of the switch lever 131*a* is matched with the set position of the operation member 133. When the switch lever 131*a* is already placed in the off position before this operation of mounting the handgrip 109 to the body 103, the switch lever 131*a* is directly led into the slit 133*d* without sliding on the inclined surface of the guide 133*c*. It may also be configured, as necessary, such that the load required to switch the operation member 133 between the on position and the off position is lighter than the load required to switch the switch lever 131*a* between the on position and the off position, the set position of the operation member 133 is matched with the set position of the switch lever 131*a*. Advantageously, with the above-described construction, when mounting the handgrip 109 to the body 103, the user does not have to check the matching of the position settings of both of the switch lever 131*a* and the operation member 133.

In this embodiment, the electrical components mounted in advance in the controller housing 140*c* of the controller 140*c* are described as to include the AC cord 150, the AC terminal 144, the power switch 131, the control unit 147, the male terminals 140*a*, 140*b*, the rotation speed control dial 148 and the motor speed sensor 149. In this invention, however, it is necessary to mount at least an AC terminal, a power switch, a control unit and a connecting terminal to the housing and form an assembly. When other electrical components are additionally incorporated into the assembly, the kind and number of the electrical components can be appropriately selected as necessary.

Further, in this embodiment, the electric hammer is described as being of the type in which the driving motor 111 is arranged such that the axis of the motor shaft 112 extends transversely to the axis of the hammer bit. However, the present invention can also be applied to electric hammers of the type in which the driving motor 111 is arranged such that the axis of the motor shaft 112 does not extend transversely to the axis of the hammer bit. Further, in this embodiment, the electric hammer is described as a representative example of the impact tool, but the present invention can also be applied to a hammer drill in which the hammer bit 119 can perform a striking movement and a rotation.

DESCRIPTION OF NUMERALS

101 electric hammer (impact tool)
103 body (tool body)
105 motor housing
105*a* bearing housing part
107 gear housing
107*a* cylindrical portion

107*b* pin guide hole
107*c* opening
108 barrel part
108*a* stepped engagement portion
109 handgrip
111 driving motor
112 motor shaft
112*a* small gear
113 motion converting mechanism
114 screw
115 striking mechanism
116 crank chamber
117 gear chamber
119 hammer bit (tool bit)
121 crank shaft
122 eccentric pin
122*a* projecting end
123 crank arm
124 crank plate
125 piston
131 power switch
133 actuating member
137 tool holder
141 cylinder
141*a* air chamber
141*b* front end large-diameter portion
141*c* air vent
142 stopper ring
143 striker
145 impact bolt
146 O-ring
151 dynamic vibration reducer (dynamic vibration reducer)
153 weight
155 front coil spring (elastic element)
157 rear coil spring (elastic element)
158 front spring receiving sleeve
158*a* front end circular portion
158*b* small hole
158*c* small-diameter portion
159 rear spring receiving sleeve
161 reduction gear mechanism
163 intermediate gear
165 intermediate shaft
167 driven gear
171 vibration mechanism (driving mechanism part)
172 cam shaft
172*a* small-diameter portion
172*b* large-diameter portion
172*c* crank plate
172*d* engagement portion
172*e* square shank
173 eccentric cam
174 power transmitting pin
174*a* one (rear) pin
174*b* other (front) pin
175, 176 bearing
177 bearing housing
177*a* upper bearing housing part
177*b* lower bearing housing part
177*c* pin guide hole
177*d* opening
178 needle bearing
181 air bleeding mechanism
182 air passage
183 filter
184 filter case
185 O-ring
186 oil filler port
187 filler port cap
187*a* square hole
188 O-ring
189 screw
191 covering member
A1 vibration reducer assembly
A2 vibration mechanism assembly

What we claim is:

1. An impact tool performing a predetermined hammering operation on a workpiece by a striking movement of a tool bit in an axial direction of the tool bit, the impact tool comprising:

a motor that drives the tool bit, a tool body that houses the motor, a dynamic vibration reducer that reduces vibration of the tool body during hammering operation, the dynamic vibration reducer comprising a weight that can linearly move in the axial direction of the tool bit and a sleeve that forcibly drives the weight, and a driving mechanism part that is driven by the motor and forcibly drives the dynamic vibration reducer by applying an external force other than vibration of the tool body to the sleeve in order to forcibly drive the dynamic vibration reducer during hammering operation, wherein:

at least one of the dynamic vibration reducer and the driving mechanism part is mounted to the tool body in a form of an assembly in which at least one of a plurality of component parts forming the dynamic vibration reducer and a plurality of component parts forming the driving mechanism part are assembled in advance, and the driving mechanism part includes:

a cam shaft that is rotationally driven by the motor, an eccentric cam that is integrally formed or fixedly connected with the cam shaft, and pins disposed in the axial direction of the tool bit, the pins being caused to linearly move in the axial direction of the tool bit by rotation of the eccentric cam in order to forcibly drive the dynamic vibration reducer, wherein at least one of the ins is mounted transversely to the axis of the cam shaft.

2. The impact tool as defined in claim 1, further comprising a barrel part connected to the tool body, and a cylinder disposed within the barrel part, wherein the dynamic vibration reducer includes an elastic element that applies a biasing force to the weight in the axial direction of the tool bit, the weight and the elastic element being mounted to either one of the cylinder and the barrel part in order to form an assembly.

3. The impact tool as defined in claim 2, wherein the sleeve is a spring receiving sleeve for receiving one end of the elastic element, the spring receiving sleeve being disposed between an outer surface of the cylinder and an inner surface of the barrel part in contact with said outer and inner surfaces, so that the cylinder and the barrel part are positioned relative to each other in a radial direction.

4. The impact tool as defined in claim 1, wherein the driving mechanism part includes a bearing that rotatably supports at least one axial end of the cam shaft, and a bearing housing that houses the bearing, all of which are assembled into the driving mechanism part, and the pins are two pins disposed in series in the axial direction of the tool bit, one of the pins which is adjacent to the eccentric cam being mounted to the bearing housing transversely to the axis of the cam shaft, whereby the driving mechanism part forms an assembly.

5. The impact tool as defined in claim 4, further comprising a driving mechanism that converts a rotating output of the motor into linear motion and drives the tool bit, and an enclosed housing space that houses the driving mechanism, wherein an air bleeding mechanism and a filler port cap are mounted to the bearing housing after the bearing housing is mounted to the tool body, so that an assembly of the driving mechanism part is formed, wherein the air bleeding mechanism provides communication between the inside and the outside of the housing space and regulates pressure of the housing space and the filler port cap closes an oil filler port from which lubricating oil is supplied into the housing space.

6. The impact tool as defined in claim 4, wherein both axial ends of the cam shaft is supported by the bearing in the assembly.

7. The impact tool as defined in claim 1 comprising:

a plurality of internal mechanisms housed within the tool body, a motor shaft as one of the internal mechanisms which is rotationally driven when the motor is driven, the motor shaft being arranged to cross an axis of the tool bit, and a covering member which is mounted to the tool body on the side of one axial end of the motor shaft and covers the end of the motor shaft, wherein the covering member retains at least part of the internal mechanisms.

8. The impact tool as defined in claim 1 comprising:

a brush holder unit that holds a plurality of motor brushes for supplying electric power to the driving motor, a connecting terminal that can be connected to a connected terminal of the brush holder unit by plugging in, a power terminal to which a power cord is connected, a power switch that can switch between a state in which the driving motor is energized and a state in which the driving motor is de-energized, and a control unit that performs controls relating to power supply to the driving motor, wherein electrical components including the connecting terminal, the power terminal, the power switch and the control unit are integrally mounted to a housing and thus form an electrical component assembly, and the electrical component assembly is mounted to the body side by connecting the connecting terminal to the connected terminal by plugging in.

* * * * *